US007259346B2

(12) United States Patent
Svyatsky et al.

(10) Patent No.: US 7,259,346 B2
(45) Date of Patent: Aug. 21, 2007

(54) PROGRESSIVE MODULARITY ASSORTMENT SYSTEM WITH HIGH AND LOW CAPACITY BINS

(75) Inventors: Ed Svyatsky, Libertyville, IL (US); Walter S. Conard, Lake Villa, IL (US); Tomasz Bednarek, Niles, IL (US); John Overman, Chicago, IL (US); Tony Estis, Morton Grove, IL (US); Mike Stollenwerck, Libertyville, IL (US); Manny Panopoulos, Chicago, IL (US); Gary VanErmen, Palatine, IL (US); Mike Swift, Libertyville, IL (US); Richard Szewczyk, Buffalo Grove, IL (US)

(73) Assignee: Bowe Bell & Howell Company, Lincolnwood, IL (US)

( * ) Notice: Subject to any disclaimer, the term of this patent is extended or adjusted under 35 U.S.C. 154(b) by 0 days.

(21) Appl. No.: 11/341,476

(22) Filed: Jan. 30, 2006

(65) Prior Publication Data

US 2006/0124514 A1 Jun. 15, 2006

Related U.S. Application Data

(62) Division of application No. 10/463,310, filed on Jun. 17, 2003.

(60) Provisional application No. 60/389,915, filed on Jun. 18, 2002.

(51) Int. Cl.
*B07C 5/00* (2006.01)

(52) U.S. Cl. ..... 209/584; 209/900; 271/292; 271/297

(58) Field of Classification Search ..... 209/630, 209/942, 900, 702, 703, 583, 584; 198/583, 198/584; 211/1.51, 1.57, 1.52; 271/303, 271/292, 298, 177, 181, 220, 207, 288, 297; 414/793.1, 793.3, 794.4, 795, 788.3, 790.9; 270/58.18, 58.21, 58.22, 58.08; 399/110
See application file for complete search history.

(56) References Cited

U.S. PATENT DOCUMENTS 3,219,204 A 11/1965 Sassen et al.

(Continued)

FOREIGN PATENT DOCUMENTS

JP 60-61442 4/1985

(Continued)

OTHER PUBLICATIONS

EP Search Report, May 2, 2006.

*Primary Examiner*—Patrick Mackey
*Assistant Examiner*—Mark Hageman
(74) *Attorney, Agent, or Firm*—McDermott Will & Emery LLP

(57) ABSTRACT

A modular bin or pocket has an integrated transport assembly and mail piece diverter assembly and is usable in a bin stacker section in mail handling and sorting systems. The modular bin is individually removable, interchangeable and replaceable from the bin stacker sections of the mail processing system to allow for repair or maintenance of malfunctioning bins leading to reduced down time of the mail processing system. The modular bin further enables vertical and/or horizontal progressive modularity, i.e., vertical and/or horizontal expansion, of the bin stacker sections of the mail processing system which allows for cost-effective expansion of mail handling systems. Further, there is closed a tray management system and a tier diverter system that are usable in mail handling systems that use the modular bin with double sided bin stacker sections or single sided bin stacker sections with or without a turnaround section.

7 Claims, 31 Drawing Sheets

U.S. PATENT DOCUMENTS

| | | | | | |
|---|---|---|---|---|---|
| 3,889,811 | A | * | 6/1975 | Yoshimura | 209/549 |
| 4,124,121 | A | * | 11/1978 | Sung et al. | 209/583 |
| 4,146,215 | A | * | 3/1979 | Mol | 270/58.2 |
| 4,190,247 | A | * | 2/1980 | Guenther | 271/291 |
| 5,135,115 | A | | 8/1992 | Miller et al. | |
| 5,150,891 | A | | 9/1992 | Svyatsky et al. | |
| 5,172,909 | A | | 12/1992 | Ricciardi | |
| 5,398,922 | A | | 3/1995 | Malatesta | |
| 5,501,449 | A | * | 3/1996 | Olexy et al. | 271/292 |
| 5,649,026 | A | | 7/1997 | Heins, III | |
| 5,971,161 | A | * | 10/1999 | Branecky et al. | 209/657 |
| 6,201,203 | B1 | | 3/2001 | Tilles | |
| 2002/0130066 | A1 | * | 9/2002 | Yuyama et al. | 209/630 |

FOREIGN PATENT DOCUMENTS

| | | |
|---|---|---|
| WO | WO99/20530 | 4/1999 |
| WO | WO99/37411 | 7/1999 |
| WO | WO 00/53344 | 9/2000 |
| WO | WO 01/12348 | 2/2001 |

* cited by examiner

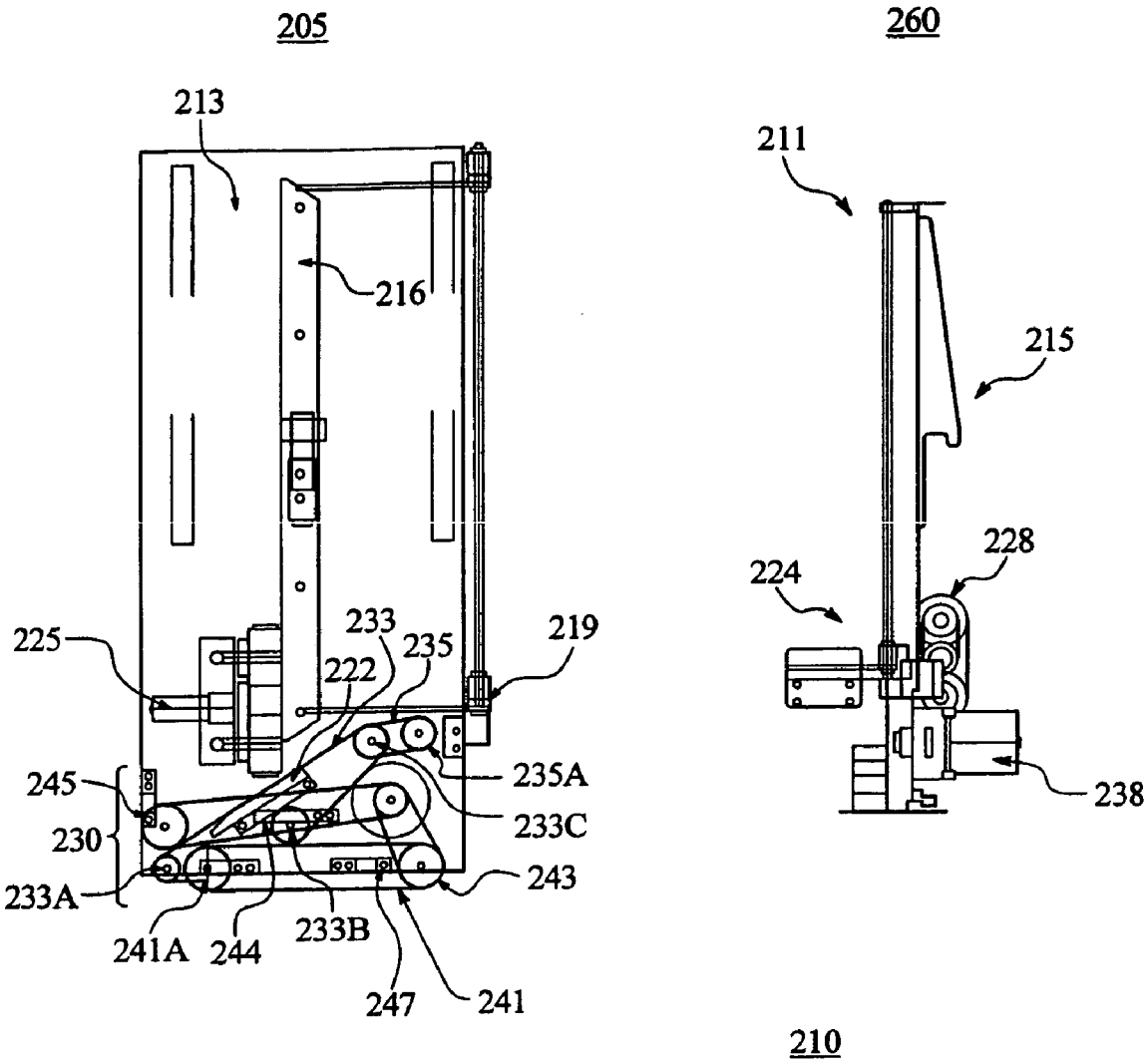
FIG. 2
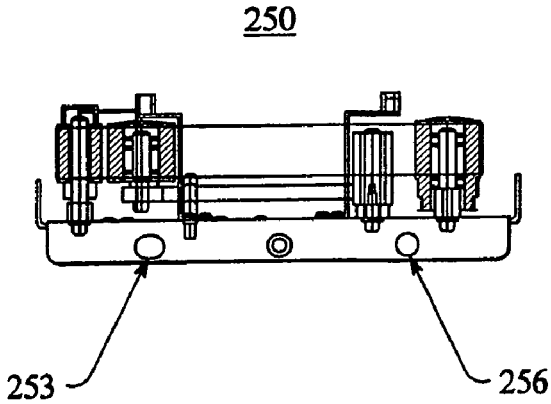

PROGRESSIVE MODULARITY ASSORTMENT SYSTEM WITH HIGH AND LOW CAPACITY BINS

RELATED APPLICATIONS

This application is a divisional of Application Ser. No. 10/463,310, filed Jun. 17, 2003, which claims priority of U.S. Provisional Application No. 60/389,915, filed Jun. 18, 2002, the contents of which are hereby incorporated by reference.

TECHNICAL FIELD

The present subject matter generally relates to automated mail processing systems for the sorting of mail and mail pieces in post offices and mail processing facilities. More particularly, the present subject matter relates to progressive modularity and removable high and low capacity bins that allow for vertical and horizontal expansion of mail processing or sorting systems. Progressive modularity allows flexible system configuration, machine expandability in both horizontal and vertical directions of single sided, or double sided units with a plurality of low and high capacity bins.

BACKGROUND

Mail sorting or handling systems are well known and are commonly used in government postal facilities and private or corporate mail handling facilities. FIGS. 1A and 1B illustrate two typical prior art single and multi-tier mail handling systems 100A and 100B. The single tier handling system 100A typically comprises a front end 3 and stacker or bin section 5 comprised of a plurality of bins 10. The front end 3 accepts mail or mail pieces to be sorted and conveyed to the stacker or bin section 5 where the mail pieces are selectively directed or guided to an appropriate bin 10. The front end 3 can be comprised of a series of conveying sections 2 which use motorized rollers, transport belts and idlers to convey or transport mail pieces from the front end 3 to the stacker or bin section 5. The number of conveying sections 2 in a system can vary depending on the specific application and use of a particular mail handling facility.

The processing or sorting of the mail pieces is typically controlled by a computer 7 with appropriate hardware and software applications to carryout desired automated mail processing functions. The front end 3 also generally comprises various auxiliary devices that in conjunction with the computer 7 allow the computer 7 to determined which particular bin 10 will receive a mail piece. The auxiliary devices can include optical character recognition readers and bar code readers among others devices.

The system 100A shown, in FIG. 1A depicts a single tier double sided stacker section 5. The single tier double sided stacker section 5 has a standard configuration that comprises a left 13 and a right side 15. Each side 13 and 15 typically comprises a plurality of bins or pockets 10 that are operatively situated adjacent to each other. The particular bins or pockets 10 each have associated transport mechanisms 17 and 19 that will appropriately operate to selectively guide a mail piece into the appropriate bin or pocket 10 upon receipt of an appropriate computer 7 command. The series of transport mechanisms 17 and 19 can include motorized rollers, compliant rollers, transport belts and associated idlers and other components. The series of transport mechanism belts form a mail path guide channel 21 where the mail pieces will travel until they are diverted into an appropriate bin or pocket 10. The mail pieces can be diverted either left to a bin 10 on the left side 13 or diverted right to a bin 10 on the right side 15.

Another type of mail handling system 100B, shown in FIG. 1B, uses a multi-tier single sided stacker section 30 with turnaround and further includes a front end 3 and a transition or elevator section 25. The transition section 25 takes the mail pieces received from the front end 3 and feeds them to the appropriate level or tier of the multi-tier single sided stacker section 30 where the mail pieces are selectively diverted to an appropriate bin or pocket 10. The mail handling system 100B shown has a configuration that comprises a rear side 32 and front side 34 operatively connected by a turnaround section 36. The rear side 32 and front side 34 typically comprise a plurality of bins or pockets 10 that are operatively connected to each other by the turnaround section 36. The bins or pockets 10 are similar to those described above and also have associated transport mechanisms that will appropriately operate to selectively guide a mail piece into the appropriate bin or pocket 10. The transport mechanisms include motorized rollers, transport belts and associated cooperative idlers. The series of transport mechanisms on each bin 10 operate in conjunction with a system transport belt and roller mechanism that are operatively situated between the front side 34 and the rear side 32 to form a double mail path guide channel where the mail pieces will travel until they are diverted into an appropriate bin or pocket 10. Unlike the double sided system 100 of FIG. 1A, the single sided system with turnaround 30 has a separate turnaround section 36, and the mail pieces can be diverted only to one side. As the mail pieces travel down the front side 34 of the multi-tier single sided stacker section 30, they can be diverted to a bin on the front side 34. In order for the mail pieces to be diverted to a bin or pocket 10 in the rear side 32, the mail pieces must completely traverse the front side 34 and traverse the turnaround section 36. The mail pieces then enter the rear side 32 where they can be appropriately diverted to a bin or pocket 10 on the rear side 32.

The double and single sided systems 100A and 100B briefly discussed can be expanded to increase mail handling capacity. Increasing mail handling capacity of existing mail handling systems is known to be done in a couple of ways. First, existing bin sections can be replaced with new larger sorting bins having the desired or necessary mail handling capacity. This can be impractical and expensive. Second, the mail handling capacity of the mail handling system 100A and 100B can be increased by the addition of stacker or bin sections 5 and 30 in an outward direction only. This is a drawback, since existing mail handling systems, like those shown in FIGS. 1A and 1B, can only be expanded by adding additional stacker or bin sections 5 and 30 in an outwardly or horizontal direction.

Generally, the second expansion approach is preferable to the first and is typically less expensive. However, expansion or increased mail handling capacity, is typically limited to horizontal or outward additions. This is often the case since the configurations and designs of existing bins 10 and standard stacker sections are such that, once a mail handling system is built, installed and operable, expansion is limited to horizontal or outward expansion because existing bin designs do not allow for vertical expansion. This can be a disadvantage where no additional floor space is available but where there is available room to grow vertically.

Another disadvantage of existing mail handling systems is that known stacker or bin sections 5 and 30 are comprised of a plurality of bins or pockets 10 that have integrated or interconnected component or diverter mechanisms such that all bins or pockets 10 within a section must operate together and simultaneously in order for the mail handling systems system 100A and 100B to be operable. This is a drawback since the malfunction or failure of the transport mechanism of any one bin or pocket 10 affects the whole system. And repair of a damaged or malfunctioning bin 10 or transport mechanism would require that the entire mail handling system be stopped during the time it takes to repair the damaged or malfunctioning bin or transport mechanism. This would also be the case for maintenance of any one or more bins 10. This is a drawback since the system cannot operate while repair or maintenance is ongoing. This aspect of interconnected or interdependent bins 10 in existing standard stacker or bin sections 5 and 30 is a drawback since malfunction, repair and maintenance of any one bin 10, transport belt or diverter will affect the mail handling system. During repairs or maintenance of system components the entire mail handling system must be stopped which results in time consuming and expensive down time for mail handling system.

There is thus a need for an improved bin or pocket that is individually removable, interchangeable and replaceable from a mail processing system without resulting in significant downtime of the mall processing system and that allows for cost-effective expansion or progressive modularity of mail handling systems.

SUMMARY

There is disclosed a novel modular bin or pocket, with an associated transport assembly and a mail piece diverter assembly, for use in a bin stacker section used in a mail handling and sorting system. The modular bin is individually removable, interchangeable and replaceable from the bin stacker sections of the mail processing system to allow for repair or maintenance of malfunctioning bins leading to reduced down time of the mail processing system. There is also disclosed an adjustable frame structure that in conjunction with the modular bin or pocket allows for vertical and/or horizontal progressive modularity, i.e., vertical and/or horizontal expansion, of the stacker sections of the mail processing system which enables cost-effective expansion of mail handling systems. Further, there is disclosed a tray management system and a tier diverter system that are usable in a mail handling system that use the modular bin with new double sided bin stacker sections or new single sided bin stacker sections with or without a turnaround section.

There is disclosed a bin for use in a mail handling and sorting system comprising a tray adapted to receive diverted mail pieces and a transport assembly positioned at a rear end of the tray and adapted to cooperate in the selective diversion of a mail piece into the tray. The mail handling and sorting system also comprises a paddle assembly movable to accommodate diverted mail pieces in the tray, a horizontal mail guide positioned on a top tray surface and configured to raise a mail piece end of the diverted mail piece as the diverted mail piece travels in the tray, and a tail removal belt assembly adapted to impart a moving force on an underside of the diverted mail pieces.

There is also disclosed a bin for use in a mail handling system comprising a tray adapted to receive diverted mail pieces, a transport assembly positioned at a rear end of the tray and adapted to cooperate in the selective diversion of a mail piece into the tray, and a mail piece tray diverter assembly adapted to selectively divert the mail piece to an adjacent and opposing bin tray. The bin also comprises a paddle assembly movable to accommodate diverted mail pieces in the tray, a horizontal mail guide positioned on a top tray surface and configured to raise a mail piece end of the diverted mail pieces as the diverted mail piece travels in the tray, and a tail removal belt assembly adapted to impart a moving force on an underside of the diverted mail pieces.

There is further disclosed a mail handling system for selectively sorting mail pieces comprising, a front end system, a transition section adapted to transport a mail piece from the front end system to a mail piece channel, and a plurality of adjacent bins operably disposed in an opposing and staggered configuration. Each bin comprises a tray adapted to receive diverted mail pieces, a transport assembly comprising a main transport belt and positioned at a rear end of the tray, and a mail piece tray diverter assembly positioned at the rear end of the tray and operable to selectively divert mail pieces to an opposing bin. The mail handling system also comprises a mail piece channel formed by the plurality of adjacent opposing transport assemblies of the plurality of opposing and staggered bins whereby mail pieces traveling in the mail piece channel are selectively diverted to a selected bin by actuation of a mail diverter assembly associated with the selected bin. The mail handling system can also comprise a tray management system with an associated take away ramp and a tier diverter system.

There is also disclosed another mail handling system for selectively sorting mail pieces comprising a front end system and a transition section adapted to transport a mail piece from the front end system to a mail piece channel. The mail handling system can also comprise a center track assembly with a center track transport belt and a plurality of mail piece diverter assemblies. The mail handling system can comprise a bin stacker section having a plurality of bins where each bin comprises a transport assembly associated with a corresponding mail piece diverter assembly. Further, in the mail handling system, the mail piece channel formed can be formed by the center track transport belt and the plurality of adjacent bin transport assemblies whereby mail pieces traveling in the mail piece channel are selectively diverted to a selected bin by actuation of a mail piece diverter assembly associated with the selected bin.

It is an objective that each modular bin can be completely removable and include its own drive motor, drive belts, and associated idlers which are integrated as part of the bin.

It is an objective to provide a removable high capacity or low capacity modular bin having drive motors, drive belts, and associated idlers integrated as part of the bin and further comprising a tray handle, a tail removal belt, a tray identification display notch and a mail guide.

It is an objective that the modular bins can be either high or low capacity bins and can be used together in combinations of high capacity or low capacity bins in mail processing systems.

It is an objective that each modular bin can be used in mail processing systems having single or double sided stacker sections and single or multi-tier configurations.

It is a further objective to enable customers to expand a mail processing machine or system from a single to a multi-tier system by using a novel adjustable frame structure, attachable tier base supports, and modular bins or pockets.

It is another objective to provide a tray management system for use with the modular bin, and adjustable frame structure and attachable tier base supports to provide improved handling efficiency of mail pieces, to improve the use of available floor space and to provide better ergonomics for mail piece handler personnel or operators.

It is an objective to provide slide trays which allow sweeping of high capacity bins in one operation.

Additional objects, advantages and novel features of the examples will be set forth in part in the description which follows, and in part will become apparent to those of ordinary skill in the art upon examination of the following and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements. The description may be better understood when read in connection with the accompanying drawings, of which:

FIGS. 2, 2A and 2B show a top, rear end and side view of an example of a bin usable with single sided stacker sections;

DETAILED DESCRIPTION

Figure 2A:
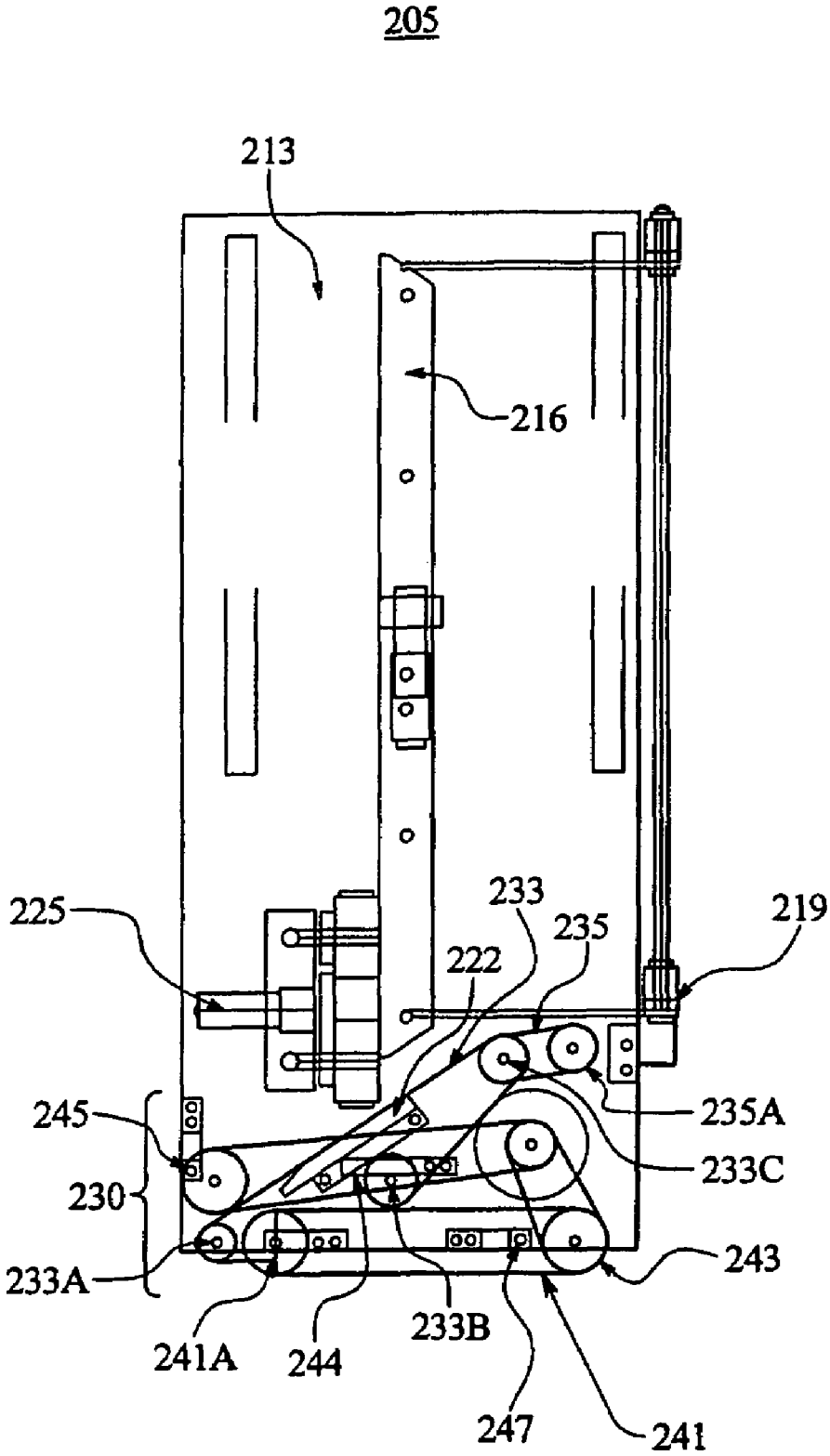
Figure 2B:
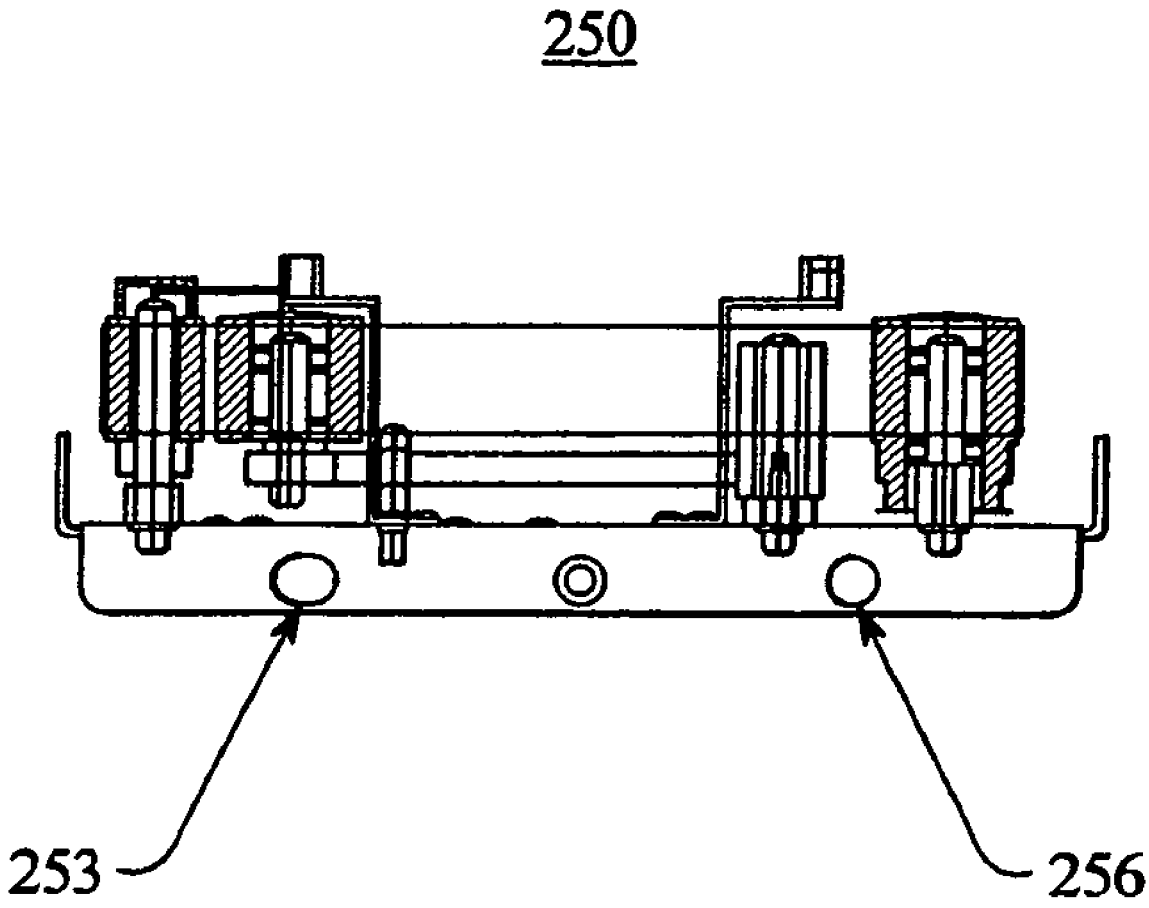
Figure 3:
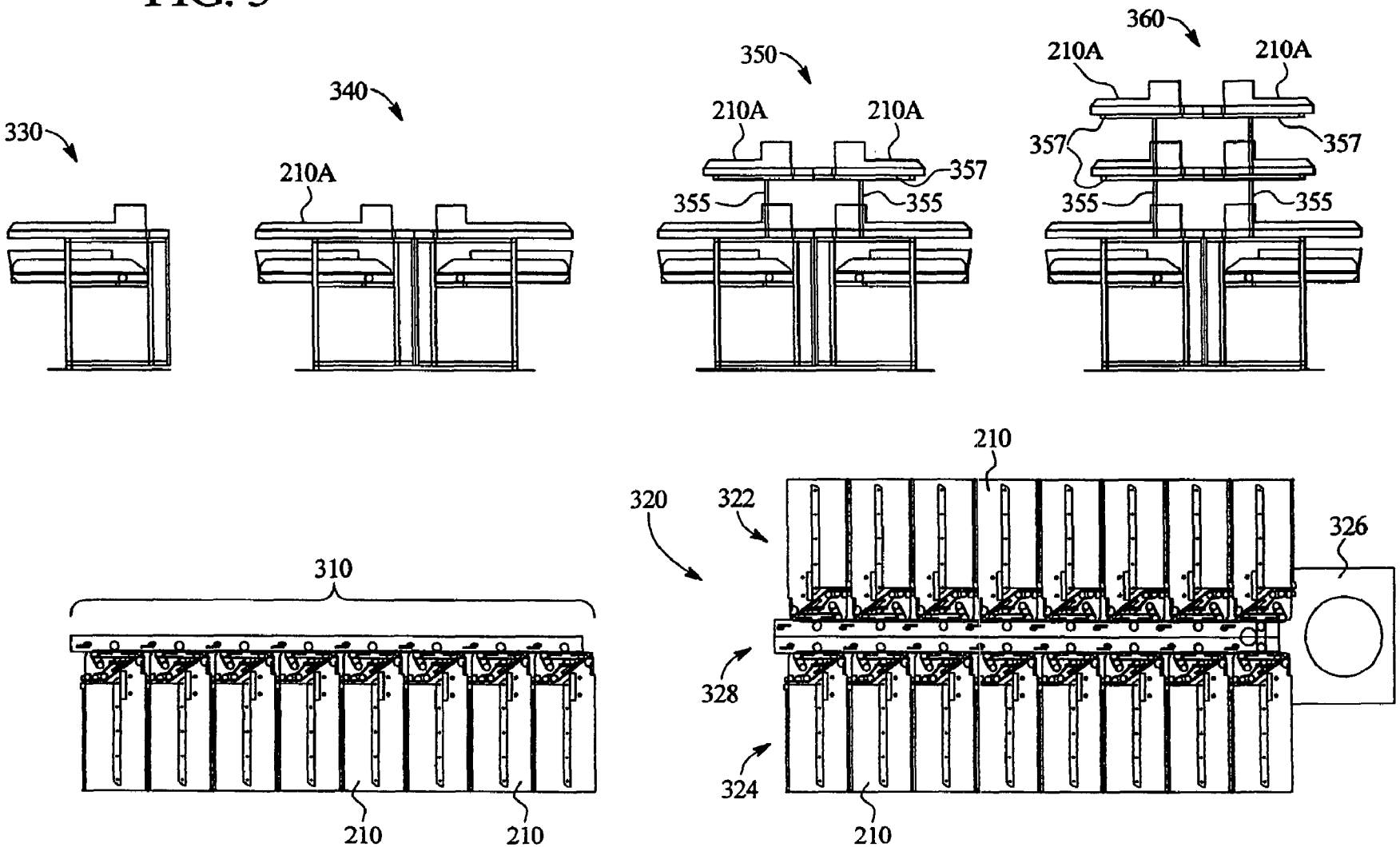
FIGS. 3, 3A, 3B and 3C illustrate examples of mail handling systems that use single sided standard stacker sections employing the bin of FIG. 2.
Figure 4:
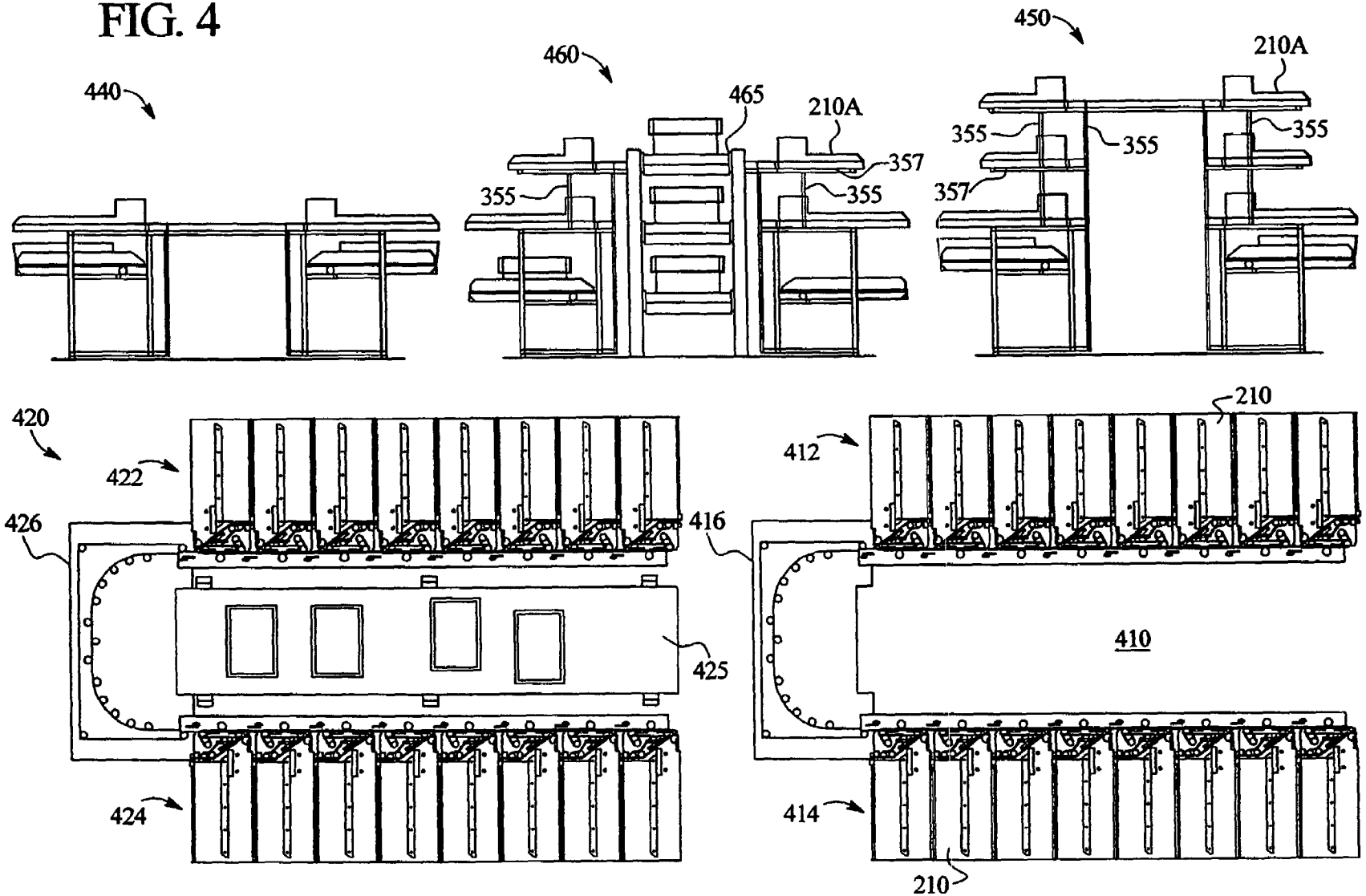
FIG. 4 illustrates examples of mail handling systems that use a tray management system and single sided standard stacker sections employing the bin of FIG. 2.

FIGS. 2, 2A and 2B show a top view 205, a rear end view 250 and a side view 260 of an example of a modular bin or pocket 210 that can be used in mail handling systems that use single sided stacker sections with or without a turnaround section 326 (shown in FIG. 3) and that use a tray management system (shown in FIG. 4). The modular bin or pocket 210 is preferably comprised of a tray 213 having a horizontal mail guide 216, a vertical mail guide 222 and a paddle assembly 219 generally disposed from a rear end 224 of the bin or pocket 210 toward a front end 211 of the pocket tray 213. The paddle assembly 219 will be operatively positioned toward the rear end 224 of the pocket 210 or adjacent to a transport assembly 230 when there are few or no mail pieces are in the tray. The paddle assembly 219 retracts toward the front end 211 of the tray 213 to accommodate the mail pieces that are diverted into the tray. The tray 213 further comprises a latch hook member 215 on the underside of the tray for operatively positioning and securing the bin or pocket 210 in a stacker section of a mail handling system. The novel bin or pocket 210 also comprises a transport assembly or mechanism 230 that makes up the rear end 224 of the bin or pocket 210. The bin or pocket 210 also comprises a locating slot and hole 253 and 256 that assist in the proper insertion and positioning of the bin or pocket 210 into a stacker section of a mail handling system.

The transport assembly or mechanism 230 can comprise, among other components, a main transport motor 238 with an associated main transport belt 241, driven roller 243 and idler 241A. The main transport can also drive a compliant driven roller 245, a round belt 235, a tray entry belt 233 and associated idlers 233A, 233B, 233C and 235A. There is also a trailing edge removal motor 225 that drives a trailing edge or tail removal belt assembly 228. The diverted assembly or mechanism 230 also includes counting and tracking sensors 244 and 247 that assist in the determination of where a mail piece will be diverted and how many mail pieces have been diverted to the tray 213.

Figure 1A:
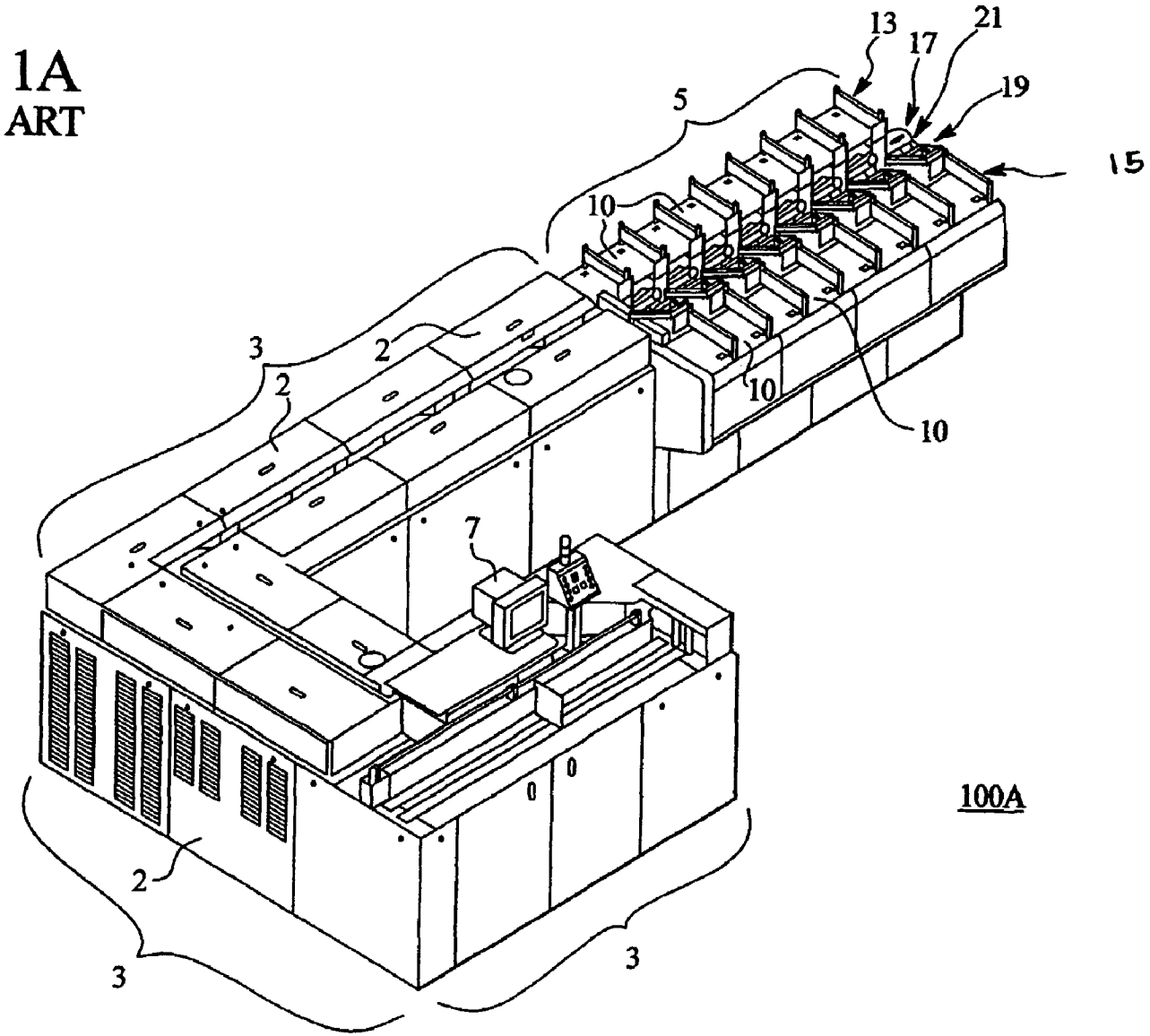
FIG. 1A PRIOR ART
FIG. 1A illustrates a prior art single tier double sided stacker section mail handling system.
Figure 1B:
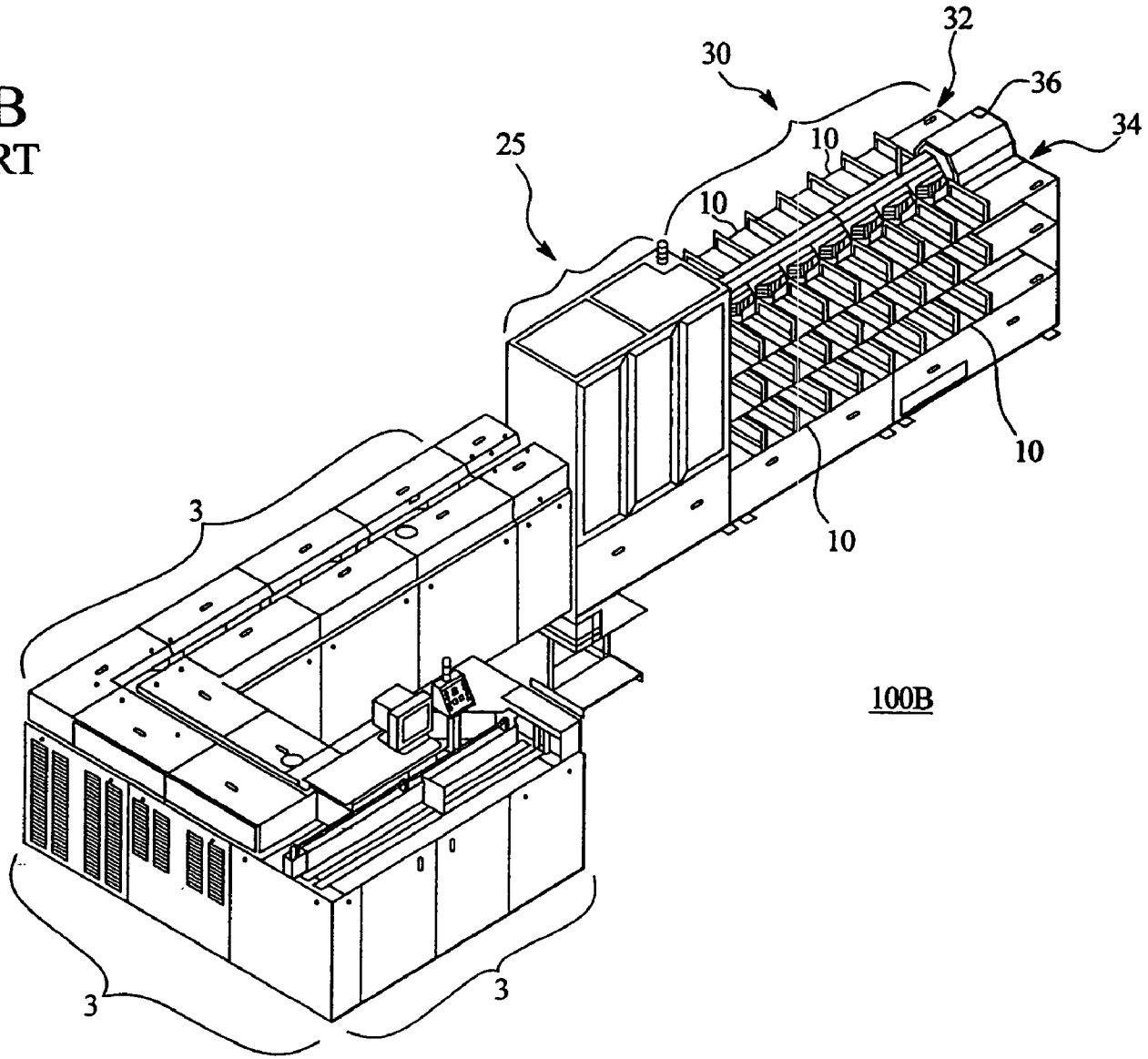
FIG. 1B PRIOR ART
FIG. 1B illustrates a prior art multi-tier mail handling system with a single sided stacker section with turnaround section.

The bin or pocket 210 is preferably a module or article that can be taken out and replaced from a stacker section in an operating mail processing system with minimal system down time required to remove or interchange pockets or bins 210. In part, this aspect of the novel bin or pocket is made possible by the fact that the modular pocket 210 is independently and separately removable and replaceable from the plurality of bin or pockets 210 in a stacker section of the mail handling system. Each pocket or bin 210 has its own set of drive motor and transport belts. Proper personnel can then remove the damaged bin or pocket 210 and either repair and replace it or simply replace it with another working bin 210. This results in improved operation of the system with minimal downtime. The pocket or bin 210 can then be repaired off-line while the mail handling system continues to operate. In comparison, existing mail handling systems (such as those of FIGS. 1A and 1B), using existing prior art bins, would have to be stopped for the entire time it takes to repair a damaged or malfunctioning bin or stacker section.

FIGS. 3, 3A, 3B and 3C illustrate two examples of single sided bin stacker section configurations 310 and 320 where the bin or pocket 210 of FIGS. 2, 2A and 2B could be employed. A typical single sided bin stacker section configuration 310 can be comprised of two, four, six, eight, ten, twelve, fourteen, or sixteen bins or pockets 210 without a turnaround section and is preferably used in a configuration with a single tier single sided stacker without turnaround configuration, shown in FIG. 3. Those of skill in the art will readily recognize that the single sided stacker bin section configurations shown in FIGS. 3 and 3A could have a greater or lesser number of bins 210 depending on the needs of a particular mail handling facility. Further, although not shown, the single tier single sided stacker without turnaround configuration 330 can be adapted for vertical and or progressive modularity, i.e., vertical or horizontal expansion.

For vertical progressive modularity, the single tier single sided stacker without turnaround configuration 330 could be vertically expanded to a multi-tiered single sided stacker without turnaround configuration by adding one of a variety of fixed length mounting posts 355 and attachable tier base supports 357 or other support means to support additional stacker sections 310 using the novel pockets 210. Further, horizontal progressive modularity can be accomplished by adding additional stacker sections 310 using the novel pockets 210 in an outward direction from the existing stacker sections 310 (similar to that shown in FIG. 10).

Figure 3A:
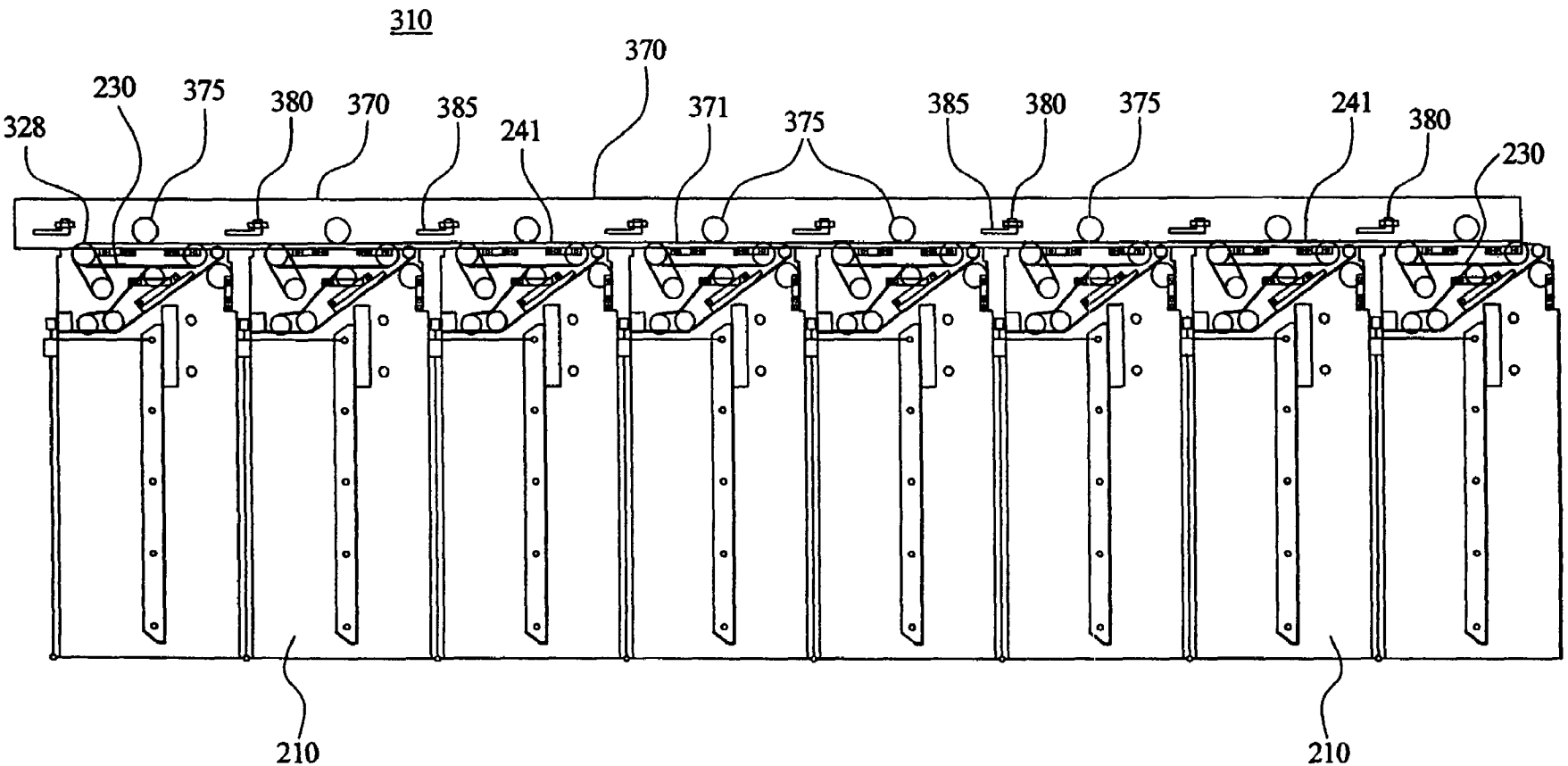

FIG. 3A illustrates with more clarity the novel pockets or bins 210 in a single sided stacker 310 without turnaround configuration. There is shown a plurality of bins or pockets 210, with their respective transport assemblies 230, positioned in a series. There is also shown a center plate or center track assembly 370 that is operatively positioned adjacent to the series of bin transport assemblies 230. The center track assembly 370 comprises a plurality of idlers 375, center track transport belt 371 and solenoid mail piece diverter assemblies 380. The solenoid diverter assembly 380 can comprise a mail piece tray diverter 385 and a solenoid that selectively actuates the mail piece tray diverter 385 to selectively divert a mail piece into a selected bin or pocket 210. In the example shown in FIG. 3A, an idler 375 and a solenoid diverter assembly 380 are preferably associated with a corresponding pocket or bin 210 in the single sided stacker section 310. Thus, the center track assembly 370 comprises an idler 375 and solenoid diverter assembly pair for the eight associated and corresponding pocket or bins 210.

FIG. 3A also shows a mail piece channel or travel path 328 formed by the center track transport belt 371 and the main transport belts 241 on each of the opposing and adjacent bin transport assemblies 230. The cooperation of the center track transport belt 371 and the main transport belts 241 allows mail pieces to travel in the mail piece channel or path along the length of the single sided stacker section 310 until the mail pieces are diverted into a selected bin or pocket 210 by actuation of the center track mail piece tray diverter 385 by a solenoid in the solenoid diverter assembly 380.

Figure 3B:
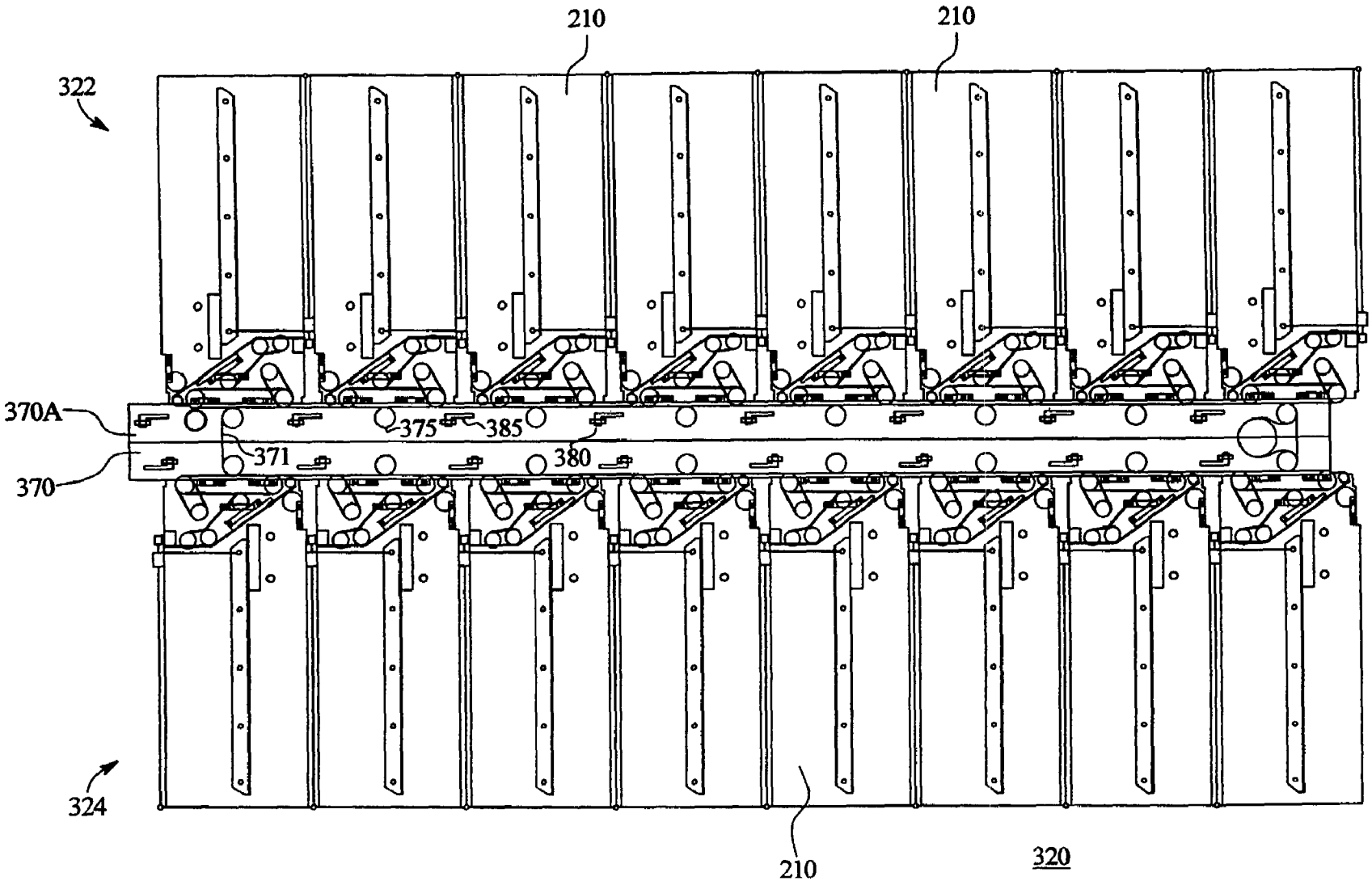
Figure 3C:
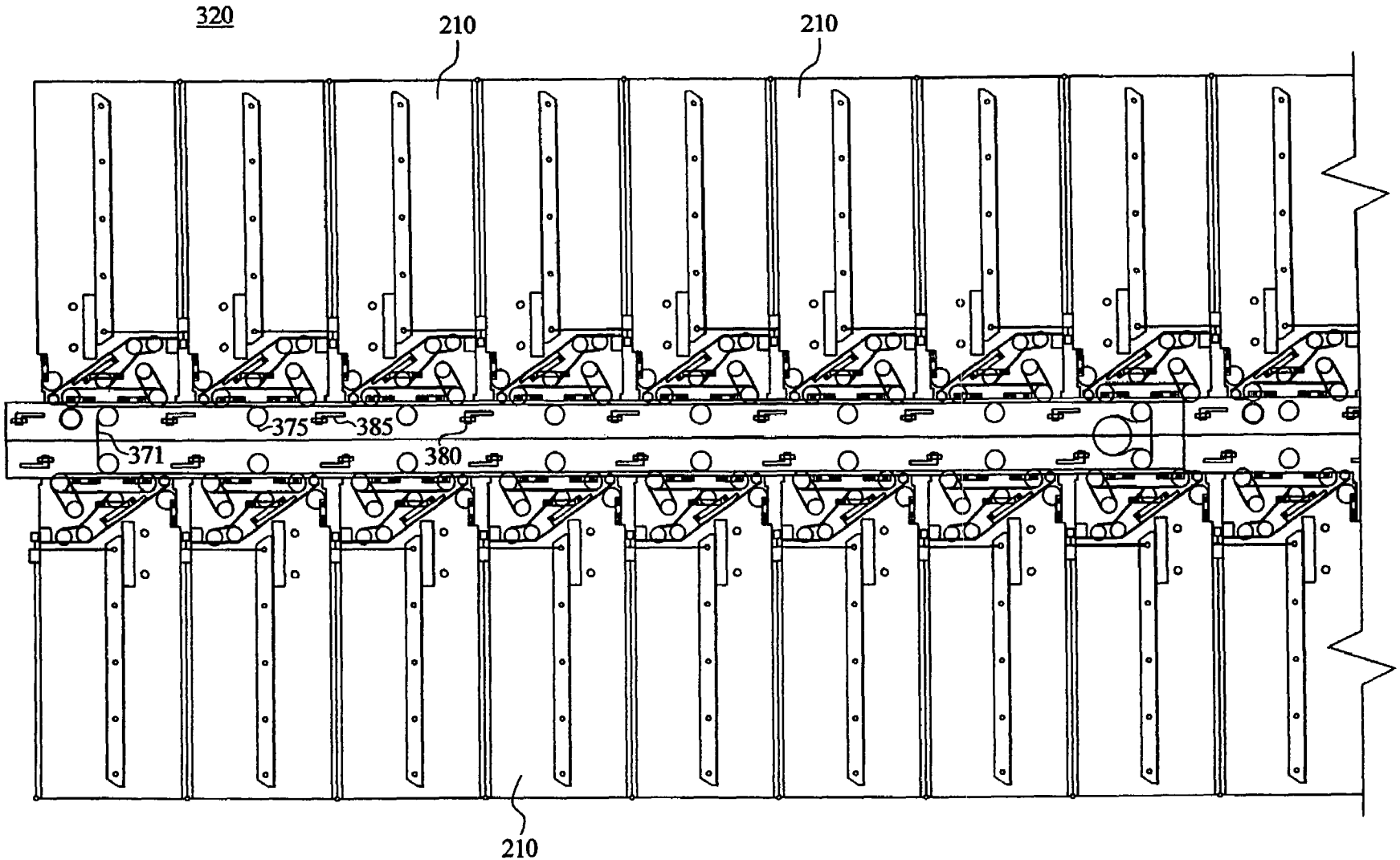

FIGS. 3, 3B and 3C also illustrate another type of single sided stacker section configuration 320 that can comprise any typical number of bins or pockets 210 with a turnaround section 326. Such a stacker configuration 320 can be used with a single tier single sided stacker with a turnaround configuration 340. As shown, the sixteen bin stacker section configuration 320 can have a front side 324 and a rear side 322, each with a set of eight pockets 210, operatively connected by the turnaround section 326. Such a single sided stacker section configuration 320 can be used in a mail processing system having a single tier single sided stacker with turnaround 340.

Figure 3D:
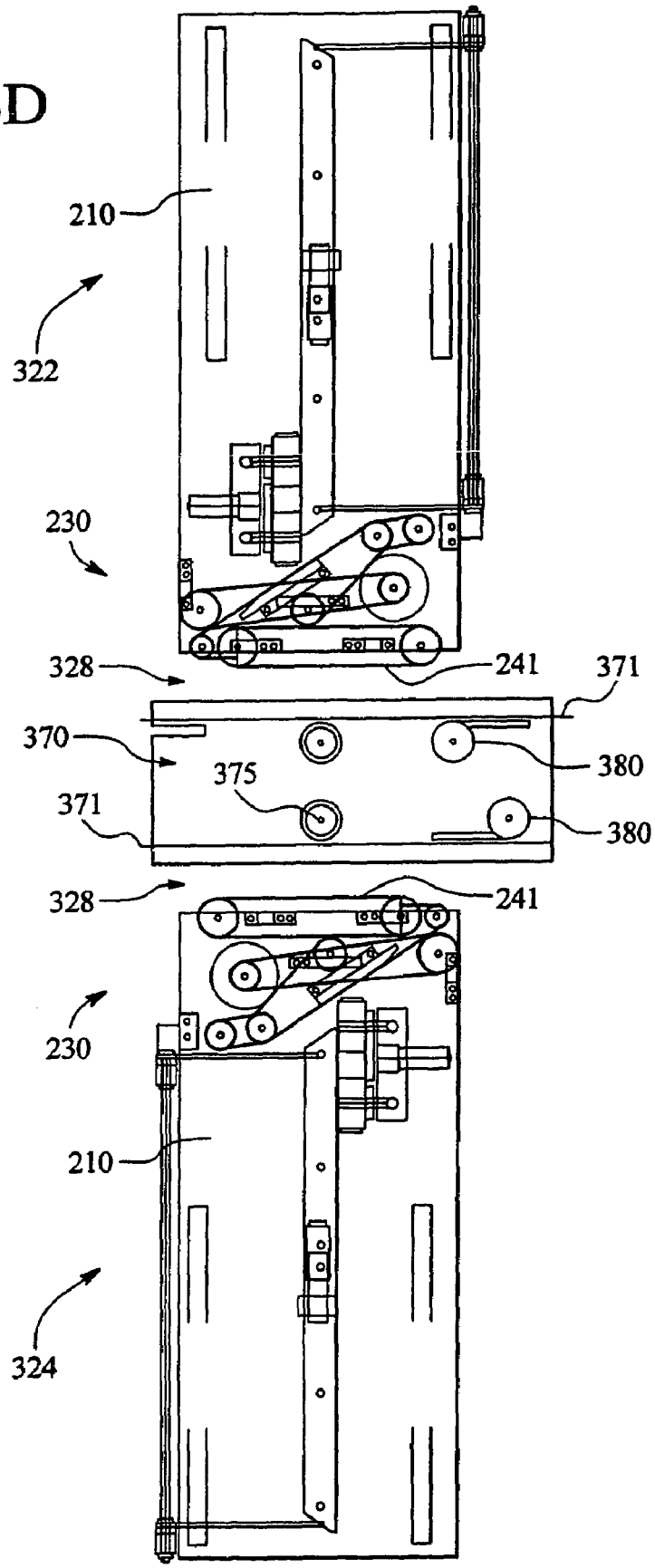
FIG. 3D shows in greater detail a mail path formed by a center track assembly and the opposing bin transport assemblies shown in FIGS. 3, 3A, 3B and 3C.

FIGS. 3B, 3C and 3D illustrate with more clarity the pockets or bins 210 in a single sided stacker 320 with a turnaround configuration 326. There is shown a plurality of bins or pockets 210 with their respective transport assemblies 230 positioned in a front side series 324 and a rear side series 322. There is also shown a center plate or center track assembly 370 that is operatively positioned adjacent to and between the front and rear series 324 and 322 of bin transport assemblies 230. As mentioned above, the center track assembly 370 comprises a plurality of idlers 375, a center track transport belt 371 and solenoid diverter assemblies 380. The solenoid diverter assembly 380 can further comprise a mail piece tray diverter 385 and a solenoid that appropriately actuates the mail piece tray diverter 385 to selectively divert a mail piece into an associated corresponding bin or pocket 210. In the example shown in FIGS. 3B, 3C and 3D, an idler 375 and a solenoid diverter assembly 380 pair are also preferably associated with a corresponding pocket or bin 210 in the single sided stacker section 310.

FIGS. 3A, 3C and 3D also show the mail piece channel or path 328 formed by the center track transport belt 371 and the main transport belts 241 on each of the opposing and adjacent bin transport assemblies 230. The cooperation of the center track transport belt 371 and the main transport belts 241 allows mail pieces to travel in the mail piece channel or path along the length of the single sided stacker section 310 until the mail pieces are diverted into a front side 324 or rear side 322 bin or pocket 210 by actuation of the center track tray diverter 385 by a solenoid in the solenoid diverter assembly 380.

Figure 11:
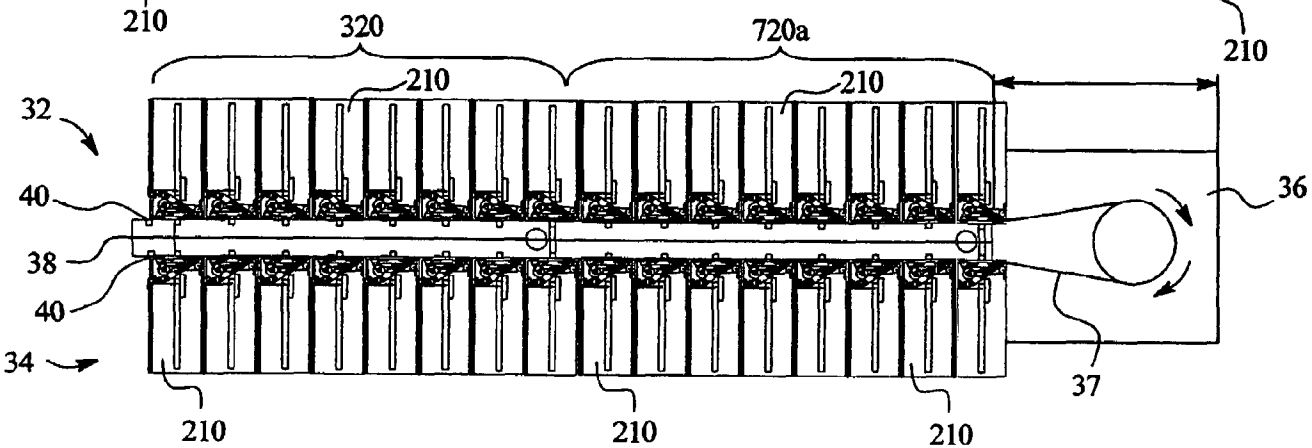
FIG. 11 shows an example of prior art horizontal expansion in a mail handling system using single sided stacker sections with a turnaround section.

Those of skill in the art will recognize that the mail handling system with the single tier single sided stacker with turnaround configuration 320 and 340 can be adapted for vertical and or progressive modularity, i.e., vertical or horizontal expansion. For vertical progressive modularity, the single tier single sided stacker with turnaround system 340 could be vertically expanded to a multi-tiered single sided stacker with turnaround configuration by the use of adjustable mounting posts 355 and attachable tier base supports 357 (more clearly shown in FIGS. 8A and 8B) or other support means to support additional bin stacker sections 320 that use the novel pockets 210. For example, FIG. 3 further illustrates examples of a mail processing systems having a two-tiered 350 and a three-tiered 360 single sided stacker with turnaround configuration. And, as before, horizontal progressive modularity can be accomplished by adding additional bin stacker sections 320 using the novel pockets 210 in an outward direction from the existing stacker sections 320 (as shown in FIG. 11).

FIG. 3 also shows a further aspect of the novel bins or pockets 210. The bins or pockets 210 can vary in sizes to fit the particular needs of a mail handling facility. In one example (see configuration 350), the bins or pockets 210 used in the stacker section 310 or 320 of a mail handling system can be either high capacity bins 210 or low capacity bins 210A. The low and high capacity bins or pockets are preferably similar or identical in construction except that the low capacity bin 210A has a short tray 213 which holds less than a full tray of mail pieces while the high capacity bin 210 has a long tray 213 that holds a full tray of mail pieces. As shown in the multi-tiered single sided stacker with turnaround configurations 350 and 360 of FIG. 3, the upper tiers preferably use the low capacity bins 210A and the low or first tiers preferably uses a high capacity bin or pocket 210. Using the low capacity bins 210A in the upper tiers generally results in ergonomic benefits to personnel handling the processed mail. However, the low and high capacity bins or pockets 210A and 210 can be used on any desired tier level and could also be mixed and matched on the same tier if desired.

FIG. 4 illustrates an example of a mail handling system that uses a single sided stacker section configuration 410 with an expanded turnaround section 416 in a single tier single sided stacker with a turnaround configuration 440. In this example, the sixteen bin stacker section configuration 410 has a front side 414 and a rear side 412 that are spaced apart from each other. The front side 414 and the rear side 412 can be spaced apart any desired distance for ergonomic benefits of personnel or handlers, for ease of maintenance, for handling efficiency, or for the use of a tray management system 425. The spaced front and rear sides 414 and 412 each preferably have a set of eight pockets 210 operatively connected by the expanded turnaround section 416. In this example, the turn around section 416 is appropriately configured to allow the mail pieces to be routed across the spaced distance from the front side 414 to the rear side 412. Such a single sided stacker section wide open configuration 410 can be used in a mail processing system having a single tier single sided stacker with turnaround 440.

FIG. 4 also illustrates a tray management system 425 used in conjunction with a single sided stacker section configuration 420 with an expanded turnaround section 426 and spaced apart front and rear sides 422 and 424. In such a configuration 420, the tray management system 425 is preferably operatively positioned between the front and rear sides 422 and 424. Such a single sided stacker section wide open configuration 420 can also be used in a mail processing system having a single tier single sided stacker with turnaround 440. Those of skill in the art will recognize that the single tier single sided stacker with expanded turnaround configuration 440, with or without the tray management system 425, can be adapted for vertical and or horizontal progressive modularity, i.e., vertical or horizontal expansion.

For vertical progressive modularity, the single tier single sided stacker with turnaround configuration 440 can be vertically expanded to a multi-tiered single sided stacker with turnaround configuration by adding one of a variety of fixed length or adjustable mounting posts 355 and attachable tier base supports 357 (see FIGS. 8A and 8B) or other support means to support additional stacker sections 410 and 420 using the novel pockets 210. For example, FIG. 4 illustrates examples of mail processing systems having a two-tiered 460 and three-tiered 450 wide open single sided stacker section with expanded turnaround configuration and with or without a tray management system. Further, horizontal progressive modularity can be accomplished by adding additional stacker sections 410 and 420 in an outward direction from existing stacker sections 410 (as shown in FIG. 9 but with a wide open or spaced apart configuration).

FIG. 4 again illustrates that that the bins or pockets 210 can be of two sizes, low capacity 210A and high capacity 210. Again, the low and high capacity pockets are preferably identical in configuration with the low capacity bin 210A having a short tray 213 and the high capacity bin 210 having a long tray 213. The upper tiers preferably use the low capacity bins 210A and the low or first tiers preferably use a high capacity bin or pocket 210 due to ergonomic benefits. However, the low and high capacity bins or pockets 210A and 210 can be used on any desired tier level and can also be mixed in the same tier if desired.

Figure 5:
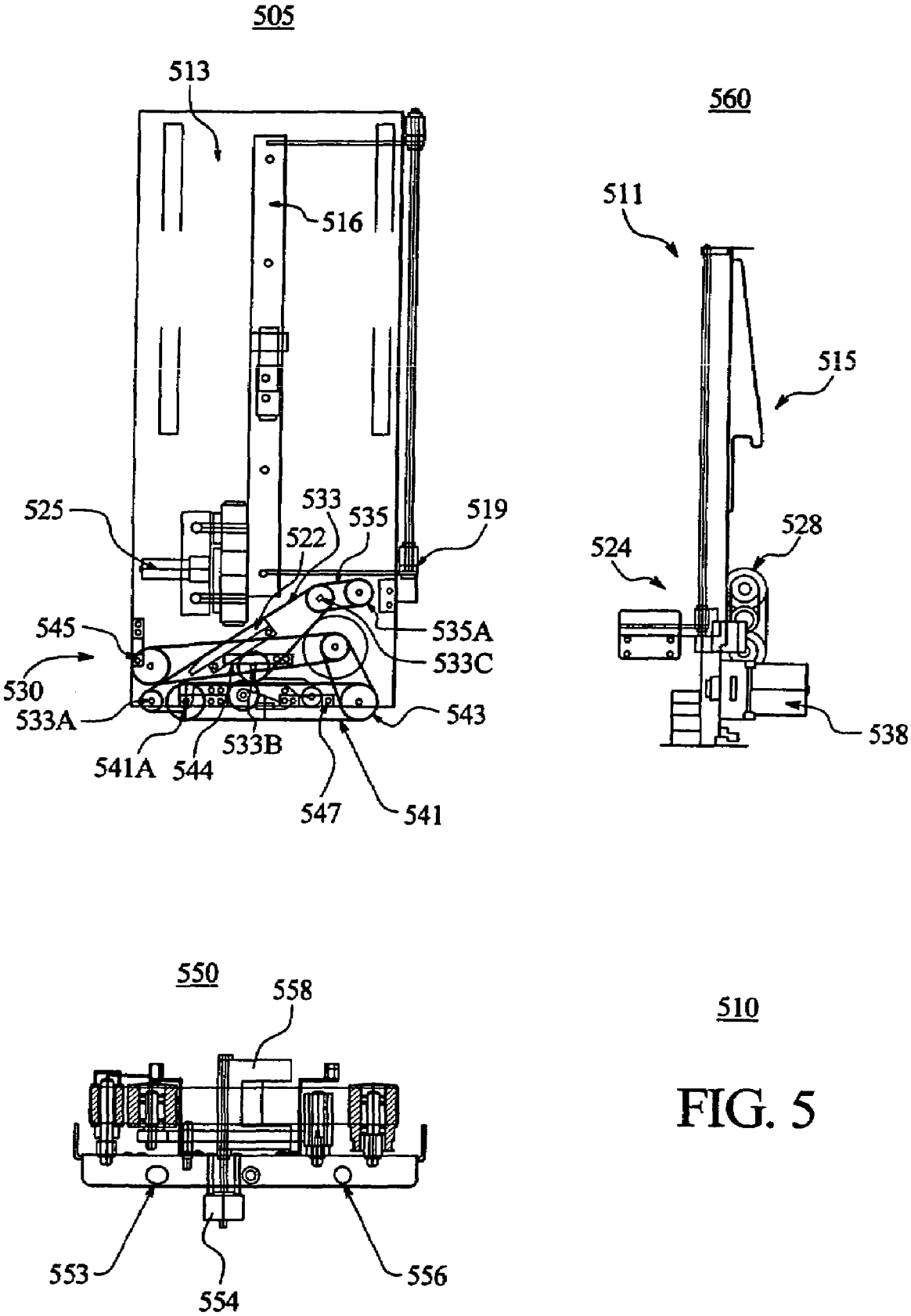
FIGS. 5, 5A and 5B show a top, rear end, and a side view of an example of a left modular bin or pocket usable with double side stacker sections.
Figure 5A:
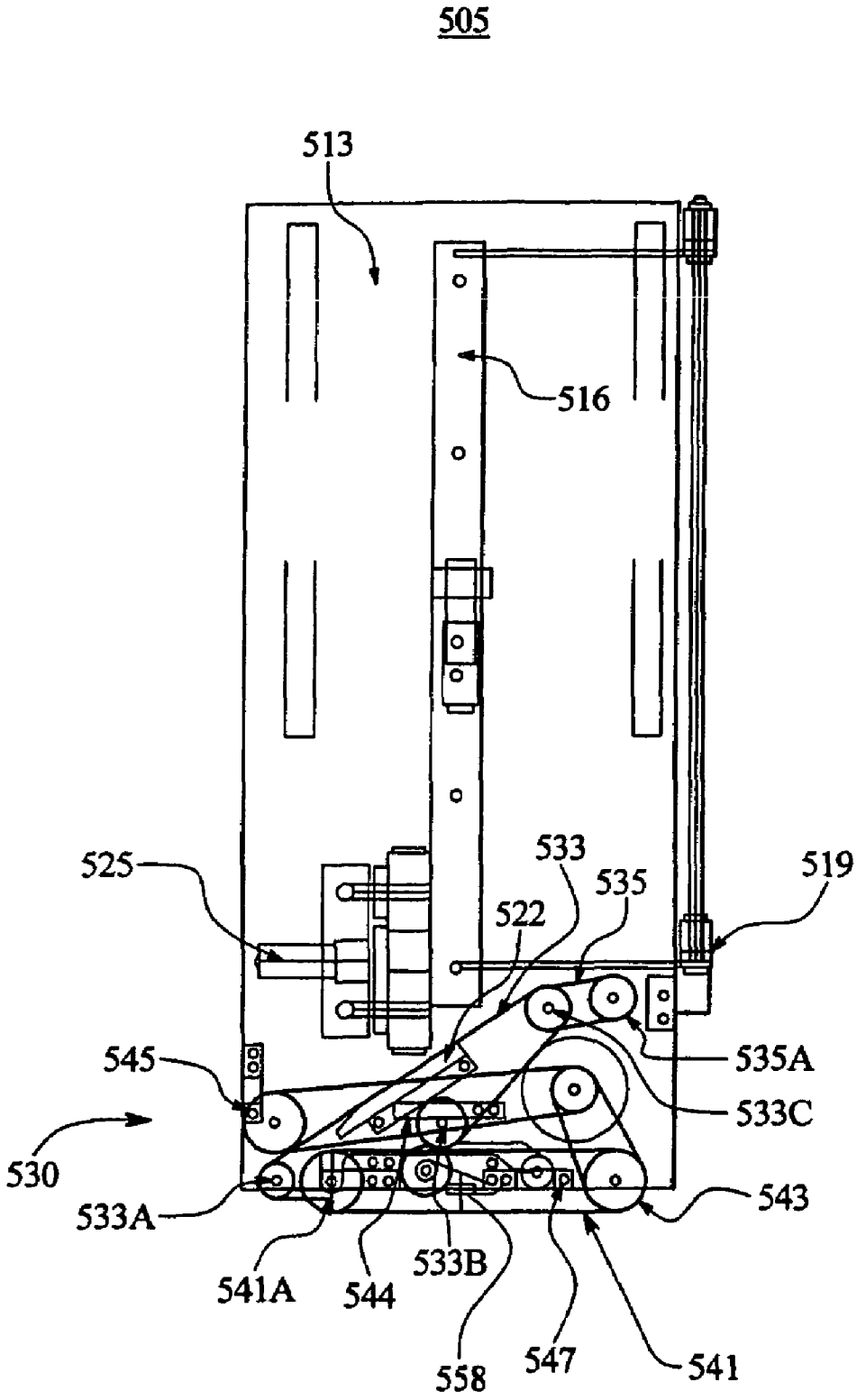
Figure 5B:
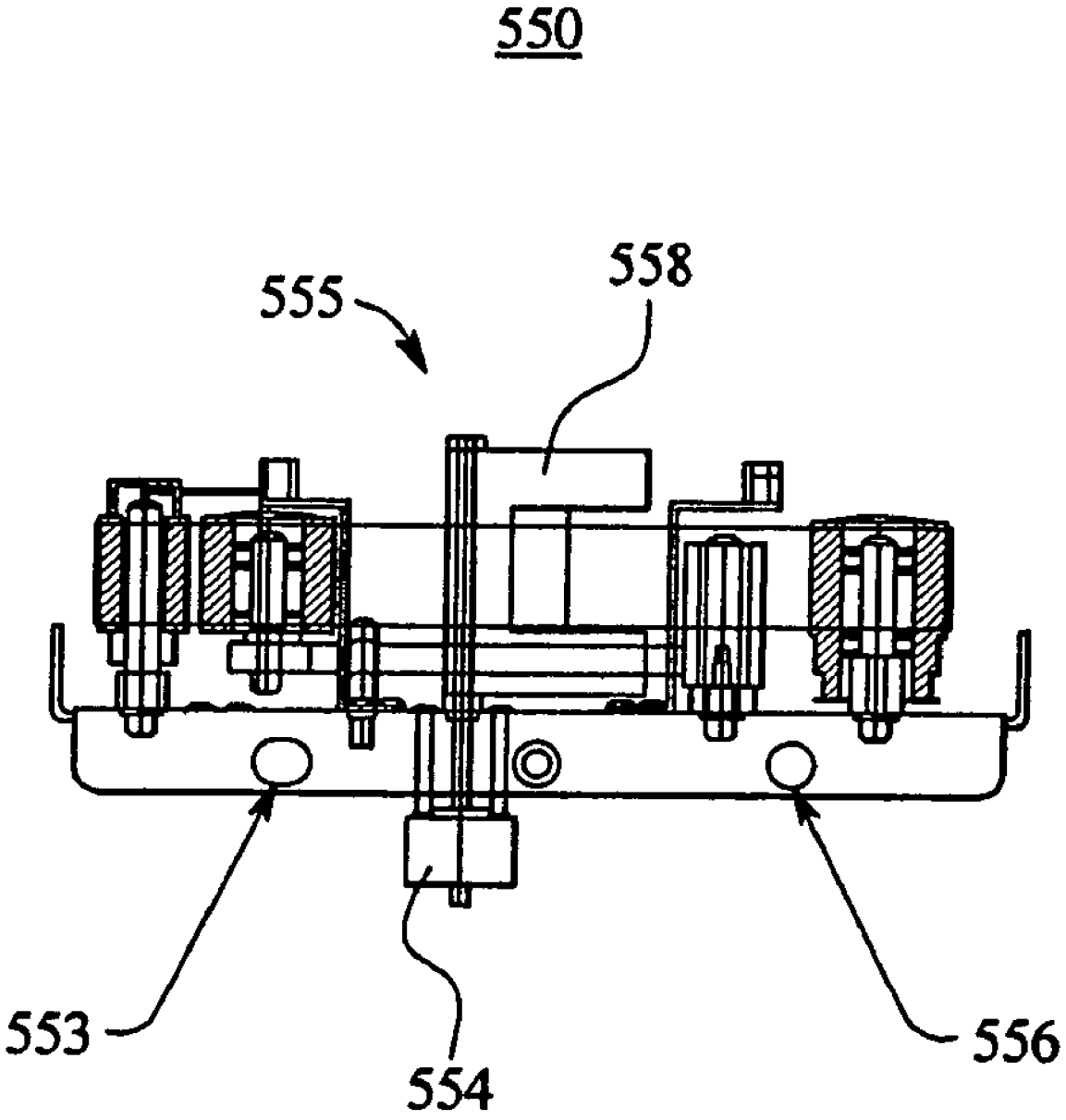
Figure 6:
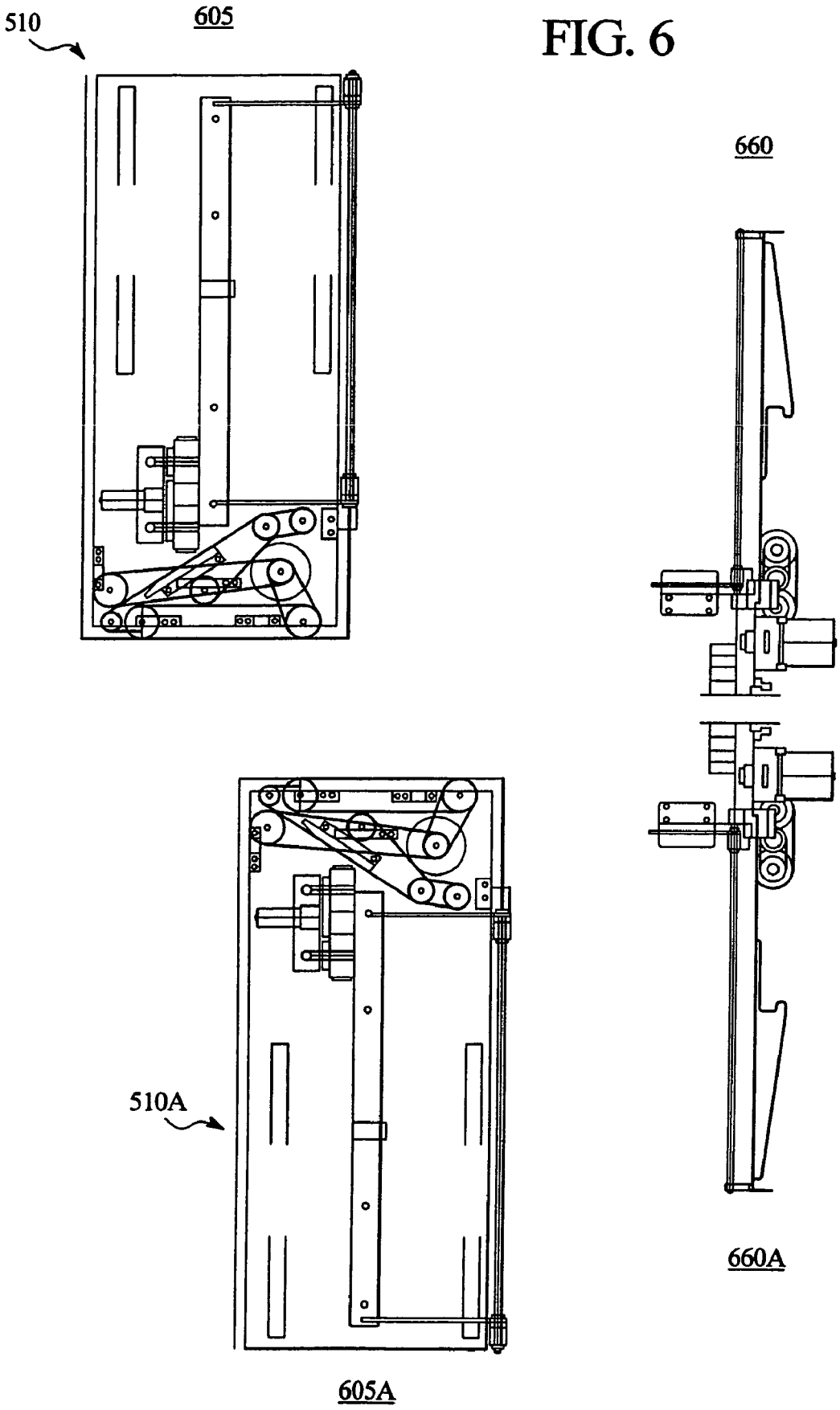
FIG. 6 shows a top and side view of the left bin or pocket of FIG. 5 and a corresponding right bin or pocket usable with double side stacker sections.
Figure 7:
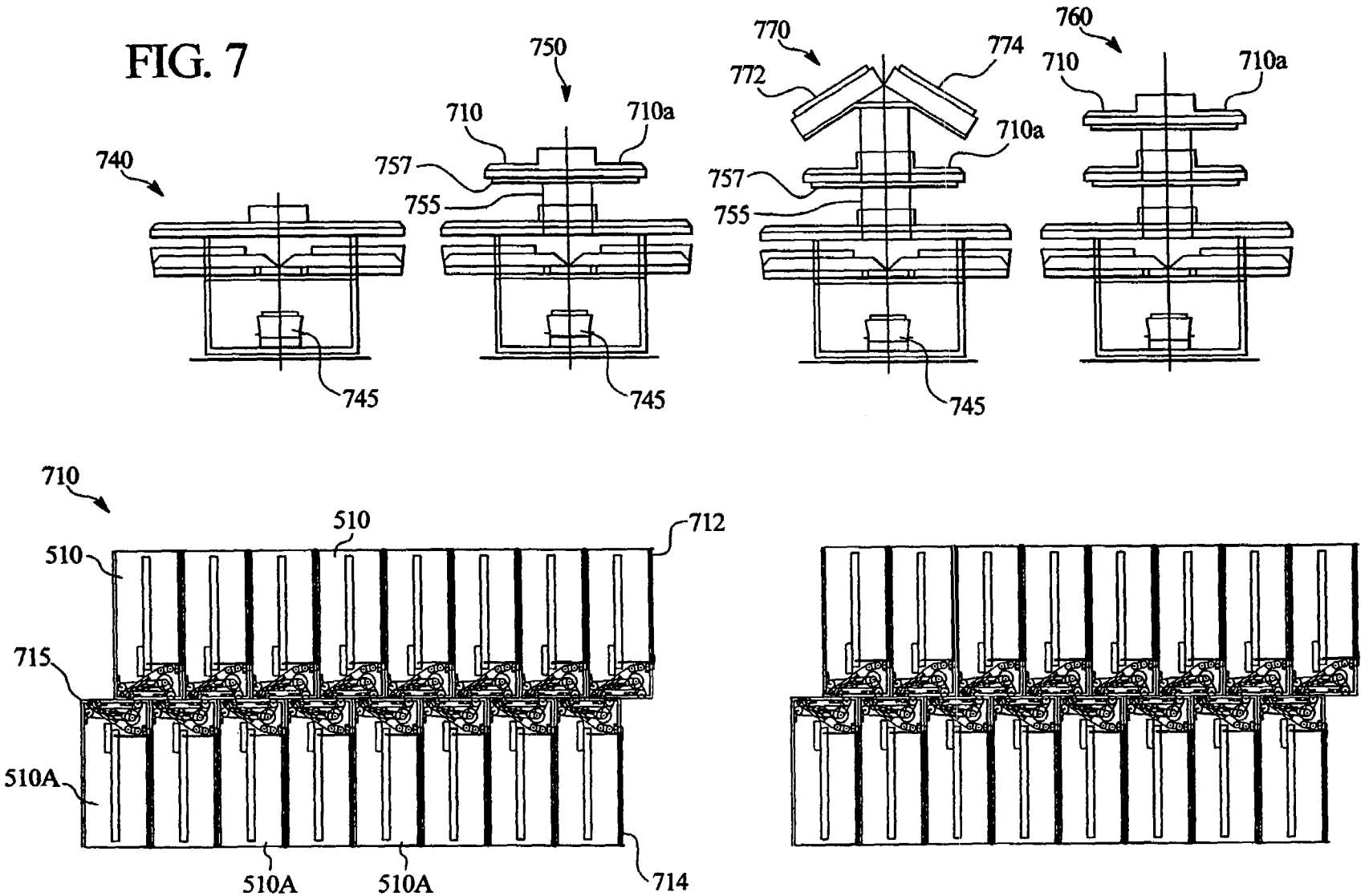
FIGS. 7 and 7A illustrate examples of mail handling systems that use a tray management system and double sided standard stacker sections employing the bins of FIGS. 5 and 6.
Figure 7A:
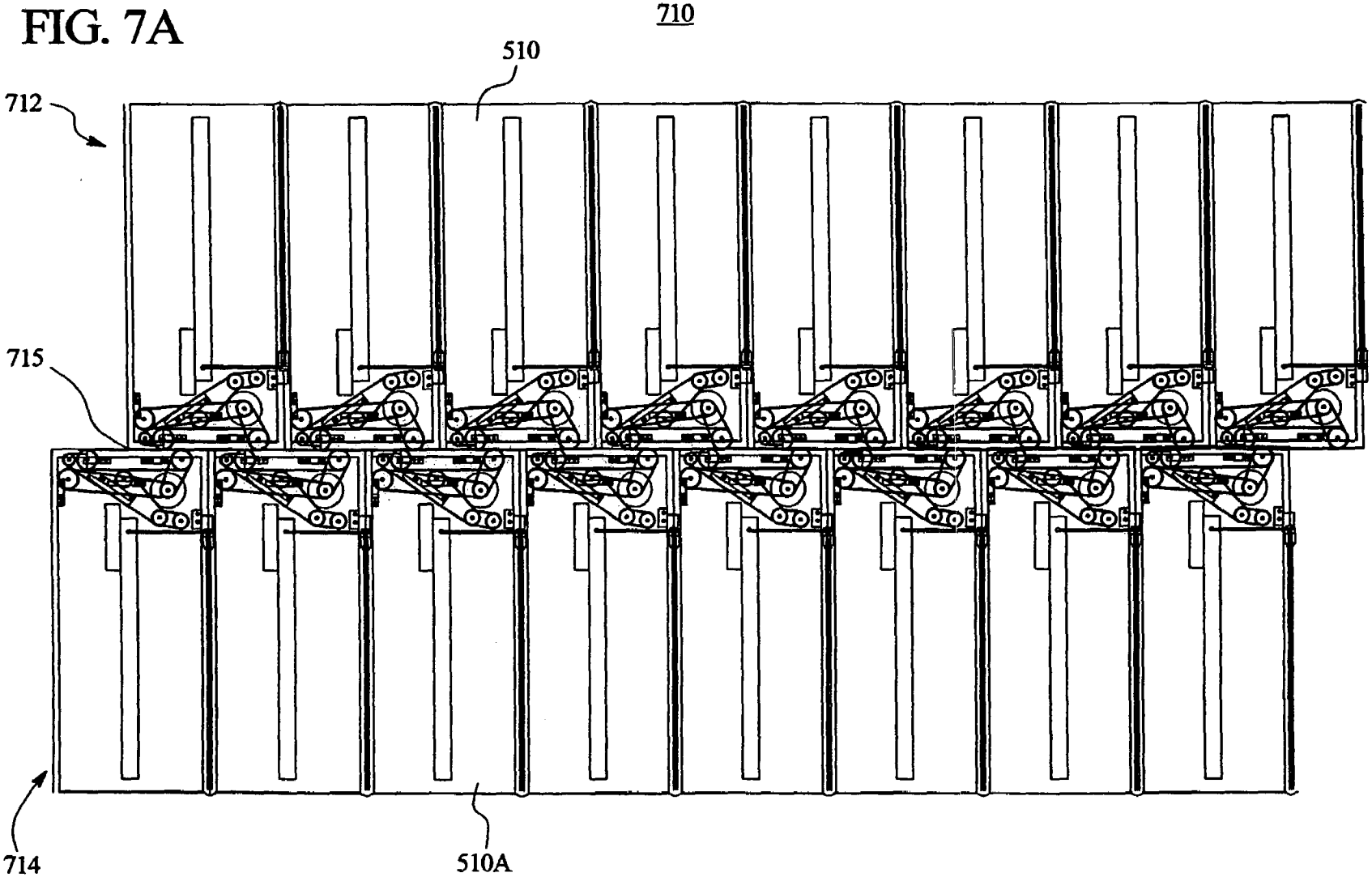

FIGS. 5, 5A and 5B show a top view 505, a rear end view 550 and a side view 560 of an example of a left modular bin or pocket 510 that can be used in mail handling systems that use double sided stacker sections 710 and a tray management system 745 (shown in FIGS. 7 and 7A). The novel left modular bin or pocket 510 of FIG. 5 is similar to the pocket 210 shown in FIG. 2. The left pocket 510 however includes additional transport mechanism or assembly 530 components. Also, the left pocket 505 has a complimentary right pocket 510A (shown in FIG. 6). In operation the left and right pockets are preferably adjacently positioned in an offset or staggered manner to thereby form a mail piece channel or path 715 (shown in FIGS. 7 and 7A) where mail pieces can travel. The left and right pockets 510 and 510A are preferably positioned in a plurality of pairs of staggered or offset left and right pocket pairs 510 and 510A to form a double sided bin stacker section 710 of a double sided stacker mail processing system (shown in FIGS. 7 and 7A).

FIGS. 5 and 6 illustrate that the left and right bins or pockets 510 and 510A are preferably the same component in a different orientation and/or can be considered mirror images of each other. Thus, the left and right bins or pockets 510 and 510A each comprise a tray 513 having a horizontal mail guide 516, a vertical mail guide 522 and a paddle assembly 519 generally disposed from a rear end 524 of the bin or pocket 510 and 510A toward a front end 511 of the pocket tray 513. The paddle assembly 519 will be operatively positioned toward the rear end 524 of the pocket 510 and 510A or adjacent to a transport assembly 530 when there are few or no mail pieces in the tray. The paddle assembly 519 travels toward the front end 511 of the tray 513 to accommodate the mail pieces that are diverted into the tray. The tray 513 further comprises a latch hook member 515 on the underside of the tray for operatively positioning and securing the bin or pocket 510 and 510A in a stacker section of a mail handling system. The novel left and right bin or pocket 510 and 510A also comprises a transport assembly or mechanism 530 that makes up the rear end 524 of the bin or pocket 510 and 510A. The bin or pocket 510 and 510A also comprises a locating slot and hole 553 and 556 that assist in the proper insertion and positioning of the bin or pocket 510 and 510A into a stacker section of a mail handling system.

The transport assembly or mechanism 530 can comprise, among other components, a main transport motor 538 with an associated main transport belt 541, driven roller 543 and spring loaded idler 541A. The main transport motor 538 can also drive a compliant driven roller 545, a round belt 535, a tray entry belt 533 and associated idlers 533A, 533B, 533C and 535A. There is also a trailing edge removal motor 525 that drives a trailing edge removal belt assembly 528. The transport assembly or mechanism 530 also includes counting and tracking sensors 544 and 547 that assist in the determination of where a mail piece will be diverted and how many mail pieces have been diverted to the tray 513. The transport assembly 530 for a bin or pocket 510 and 510A used in a double sided stacker section, shown in FIGS. 5, 5A and 5B, comprises a solenoid diverter assembly 555 having a downstream mail piece tray diverter 558 associated with a solenoid 554 that actuates the downstream mail piece tray diverter 558 to selectively divert a mail piece into an associated corresponding bin or pocket 210. This is in contrast to the bins 210 used in the single sided stacker sections of FIGS. 3, 3A-3D, and 4 which can have the solenoid diverter assembly 555 adjacent to the center track assembly 370.

Similar to the bin or pocket 210 discussed with reference to FIG. 3, the novel left and right bin or pockets 510 and 510A are modular and can be taken out and replaced from a stacker section in an operating mail processing system with minimal system down time. This feature is possible because the left and right pockets 510 and 510A are each modular and can be independently removed and replaced from the stacker sections 710 in a mail handling system. Further, the transport mechanism 530 of each pocket or bin 510 and 510A is preferably powered independently from other pockets or bins 510 and 510A in a stacker section 710. Thus, the malfunction or failure of any one bin or pocket 510 and 510A of the transport assembly 230 will not significantly affect the operation of the mail handling system since the system only needs to be stopped for replacement of the malfunctioning bin 510. Proper personnel can then remove the damaged bin or pocket 510 or 510A and either repair and replace it or simply replace it with another working bin 510 and 510A. This results in continued and consistent operation of the system. In comparison, existing mail handling systems (such as those of FIGS. 1A and 1B) using existing prior art bins 10 would have to be shut down upon the failure of any one bin 10 due to the integrated nature and make up of transport mechanism in existing bins and stacker sections.

Figure 13A:
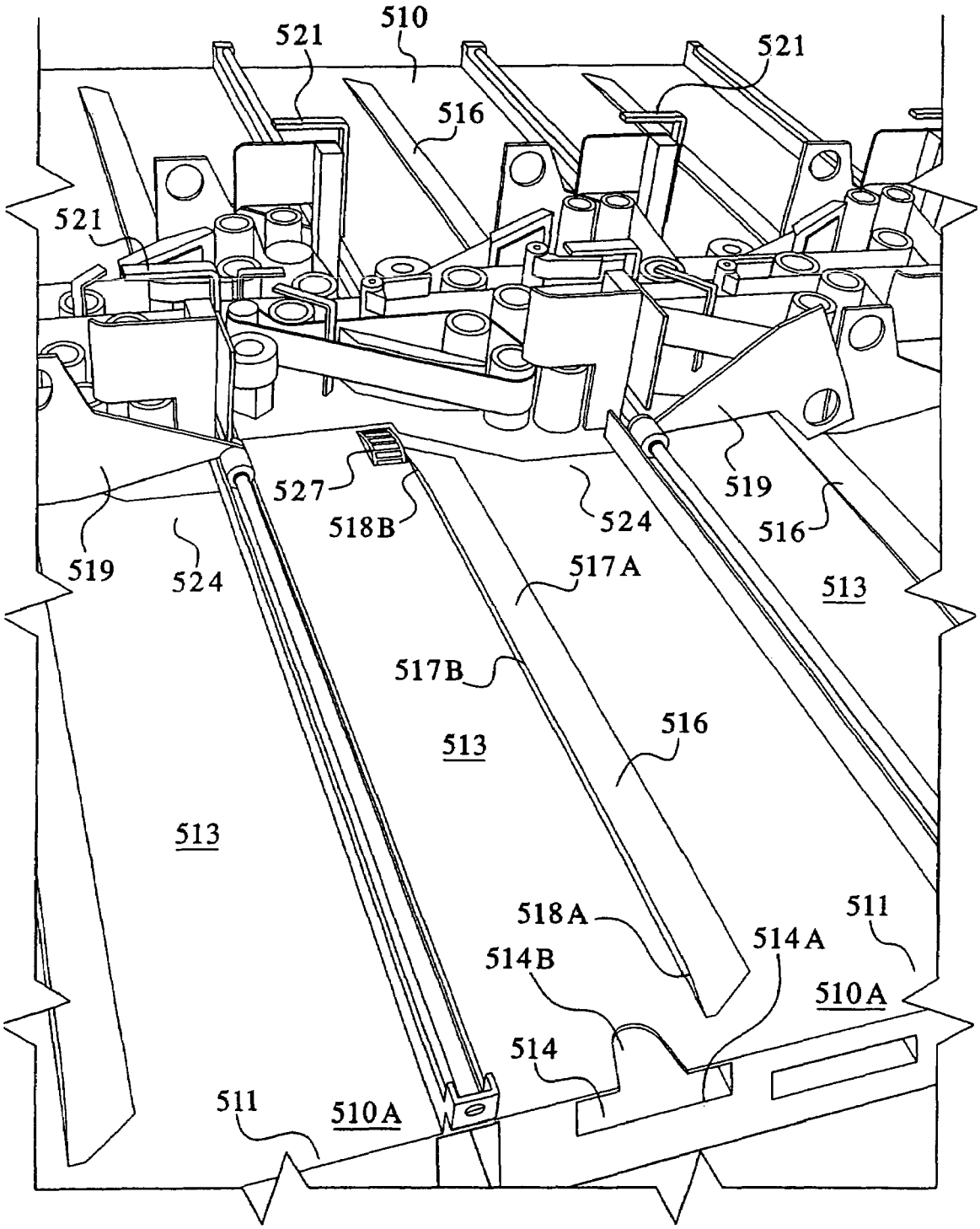
FIGS. 13A and 13B illustrate a top isometric view of a bin according to another example useable with double side stacker sections.
Figure 13B:
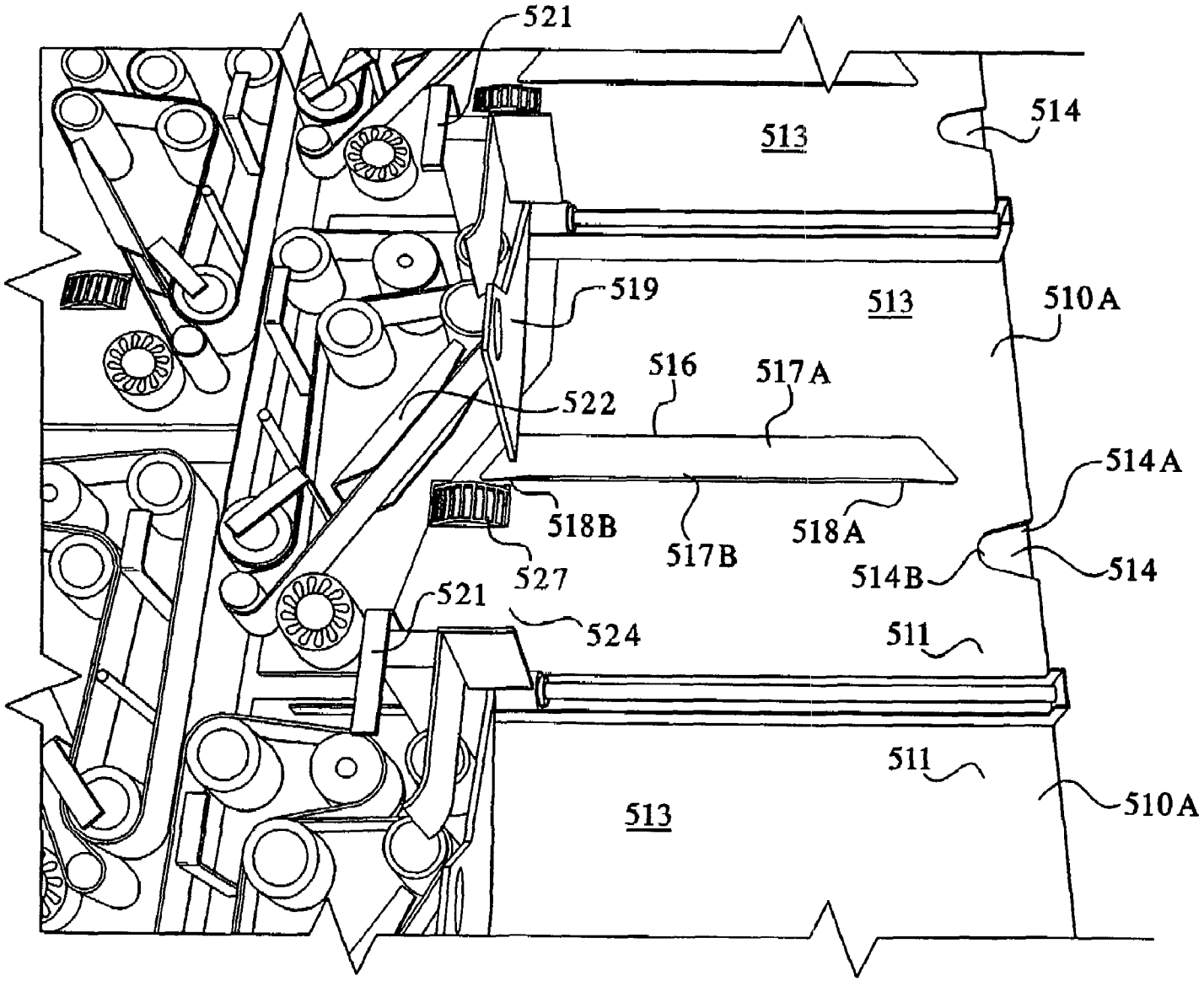
Figure 13C:
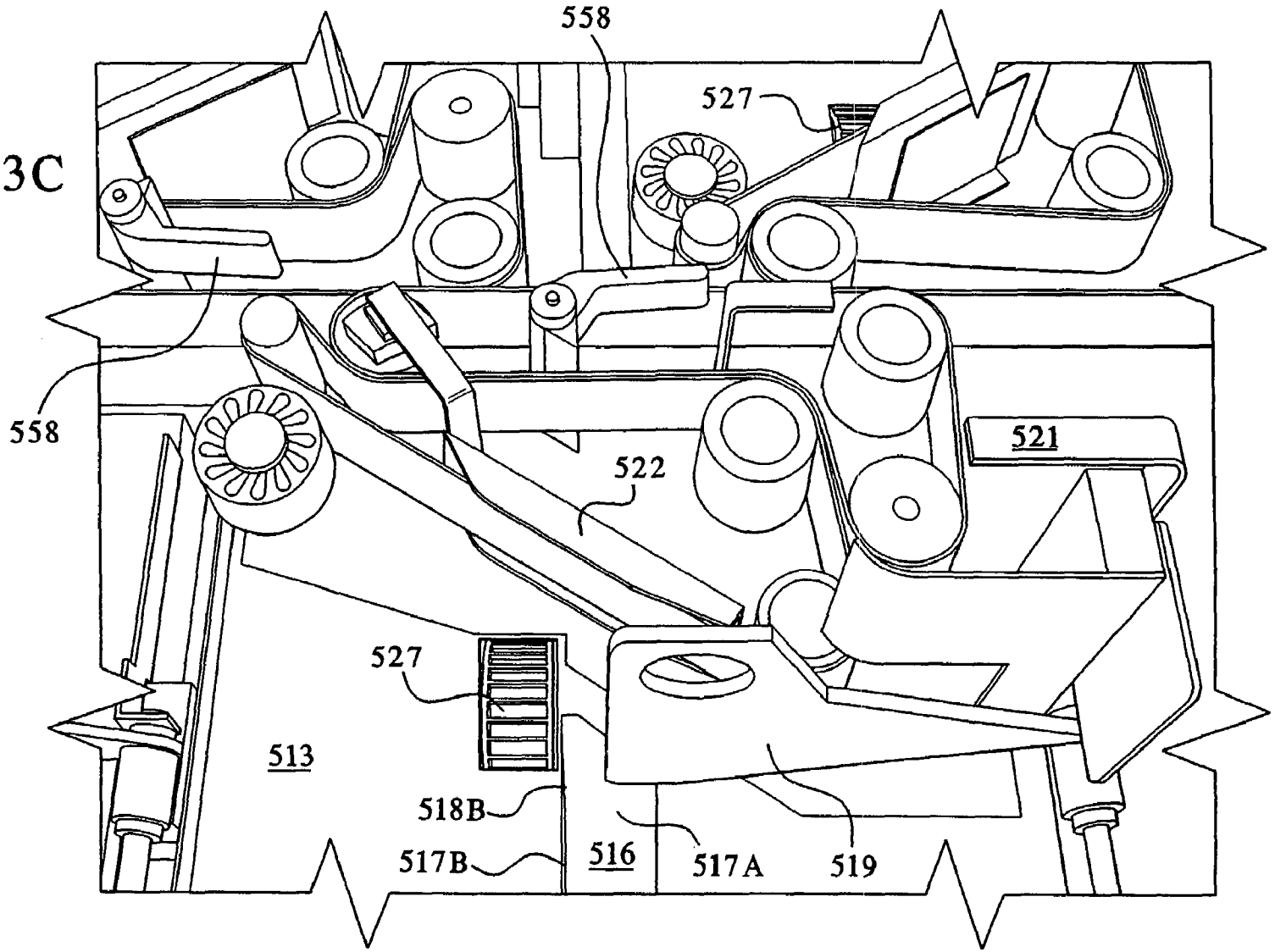
FIG. 13C illustrates a view of the rear end of the bin of FIGS. 13A and 13B.

Referring to FIGS. 13A-13C, there is shown a top isometric view of another example of the modular bins or pockets 510 and 510A that can be used with double side stacker sections. FIGS. 13A and 13B illustrate high and low capacity pockets 510 and 510A, respectively. In this example, the modular bins or pockets 510 and 510A are similar to the bins or pockets 510 and 510A previously described and shown in FIGS. 5, 5A, 5B and 6, and further depict a horizontal mail guide 516, a tail removal belt 527, a tray handle 521 and a bin display card section 514. Those of skill in the art will readily recognize that these features or aspects can also be incorporated or implemented in the modular bins or pockets 210 and 210A used with the single side stacker sections described previously and shown in FIGS. 2-4.

A tray handle 521 is preferably positioned in the rear end 524 of the tray 513 of the pockets 510 and 5100A adjacent to the transport assembly 530. The tray handle 521 is configured such that an operator or user can, once the tray is disengaged from the pocket 510 and 510A, conveniently lift the entire tray 513 by grasping and lifting at the tray handle 521 for movement and transport of the tray 513. In the example shown, the tray handle 521 is an L-shaped member that is securely attached to the pocket 510 and 510A. The L-shaped tray handle 521 is a single integrated piece, however, the tray handle 521 may be comprised of one or more component pieces. The tray handle 521 can be attached to the tray 513 by fastening means known to those of skill in the art. For example, using bolts, screws, rivets, etc. Also, the tray handle 521 can be comprised of metal, heavy strength plastic or other material that can adequately support the weight of a pocket 510 and 510A fully loaded with mail pieces.

The horizontal mail guide 516 is preferably a substantially lengthwise member that is positioned on the tray 513 surface such that the mail guide substantially spans the tray 513 from the rear end 524 to the front end 511 of pocket 510 and 510A as shown in FIGS. 13A and 13B. The horizontal mail guide 516 is preferably comprised of a single metallic piece that is formed or bent such that there results a horizontal flat portion 517A and a short vertical portion 517B. The resultant cross-section of the horizontal mail guide 516 has an L-shaped configuration. The short vertical portion 517B of the horizontal mail guide 516 has a tapered or ramped front end 518A and rear end 518B. The horizontal mail guide 516 can also be comprised of one or more component pieces coupled to form the L-shaped configuration with a vertical portion 517B. The horizontal mail guide 516 can be comprised of other materials besides metal, including plastic, ceramic, wood, etc. Those of ordinary skill in the art will readily recognize that the horizontal mail guide 516 can simply be a lengthwise vertical member or portion.

Figure 13D:
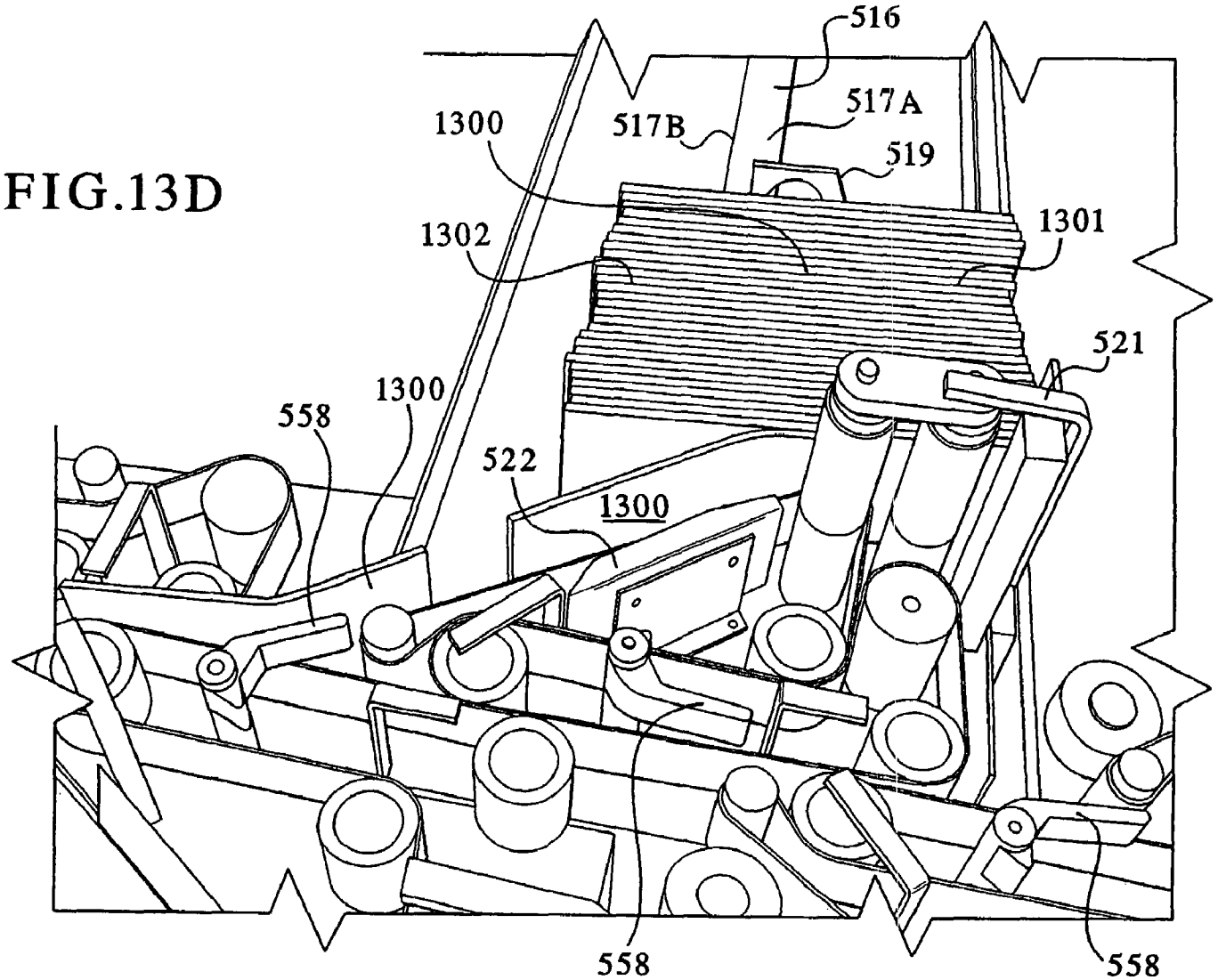
FIG. 13D illustrates the bin of FIGS. 13A-13C during operation of the bin.

The tapered or ramped rear end 518B of the vertical portion 517B at the rear end 524 of the tray 513, also shown in FIG. 13C, preferably enables the back end 1302 of diverted mail pieces 1300 to be lifted from the tray 513 onto the vertical portion 517B of the horizontal mail guide 516 as a diverted mail piece 1300 travels from the rear end 534 towards the front end 511 of the tray 513 as additional mail pieces 1300 are diverted in the tray 513, as shown in FIG. 13D. The lifting of the back end 1302 of the diverted mail pieces 1300 ensures that only the front end 1301 of the diverted mail pieces 1300 contact the tray 511 surface as the diverted mail pieces 1300 move from the rear end 534 towards the front end 511 of the tray 513, as shown in FIG. 13D. The fitting by the vertical portion 517B configuration reduces friction encountered by the diverted mail pieces 1300 as the diverted mail pieces 1300 travel from the rear end 534 towards the front end 511 of the tray 513 and also reduces fanning of the diverted mail pieces 1300. The reduced friction and fanning enables the diverted mail pieces 1300 to more easily travel on the tray 513 surface.

FIGS. 13A-13C also show an example of a tail removal belt or roller 527 that can be used in high and low capacity modular bins or pockets 510 and 510A that can be used with the double side stacker sections shown in FIGS. 5, 5A, 5B and 6. The tail removal belt or roller 527 can also be used with the high and low capacity modular bins or pockets 210 and 210A used in the single side stacker sections shown in FIGS. 2-4. The tail removal belt or roller 527 can be driven by a trailing edge removal motor 222 and 522, shown in FIGS. 2, 2A, 5 and 5A. The trailing edge removal motor 222 and 522 may be part of the transport assembly or mechanism 230 and 530 or may be separate. The tail removal belt or roller 527 is preferably positioned in the rear end 534 of the tray 513 adjacent to the vertical mail guide 222 and 522 and adjacent to the tapered rear end 518B of the vertical portion 517B of the horizontal mail guide 522, as shown in FIGS. 13A-13C. The tail removal belt or roller preferably operates to assist in the movement of the diverted mail pieces 1300 from the rear end 534 to the front end 511 of the tray 513 as mail pieces 1300 are diverted into the tray 513, as shown in FIG. 13D. The tail removal belt or roller 527 imparts a moving force on the underside of the diverted mail pieces 1300. The moving force further assist the ends 1301 and 1302 of the diverted mail pieces 1300 overcome friction encountered as the diverted mail pieces 1300 travel on the tray surface and the vertical edge 517B of the horizontal mail guide 516. The tail removal belt or roller 527 also reduces fanning of the diverted mail pieces 1300 which can allow for easier movement of the diverted mail pieces 1300 in the tray 513. The tail removal belt or roller 527 preferably uses a notched rubber-type belt or roller, shown in FIG. 13C, however, other known belt or roller configurations that can impart force on the diverted mail pieces and reduce fanning can be used.

FIGS. 13A and 13B further show an example of a bin display card section 514 that can be implemented in the high and low capacity modular bins or pockets 510 and 510A that can be used in double side stacker sections shown in FIGS. 5, 5A, 5B and 6. The bin display card section 514 can also be implemented in the high and low capacity modular bins or pockets 210 and 210A that can be used in single side stacker sections shown in FIGS. 2-4. The bin display card section 514 is preferably located in the front end 511 of the tray 513 and preferably serves as a location for an identification card or placard. The card or placard could identify or provide information about the tray 513, e.g., tray number 3, or information about the mail pieces being diverted to that tray 513. The bin display card section 514 preferably comprises a card insert area or slot 514A that accepts the identification card or placard and an access slot 514B that permits insertion and removal of the card or placard from the card insertion area 514A.

FIGS. 7 and 7A illustrate an example of a mail handling system that uses a double sided stacker section configuration 710 in a single tier configuration 740 with a tray management system 745. It will be readily apparent that the single tier double sided stacker configuration 740 could also be implemented without a tray management system 745. In this example, there is no center track assembly 370 with a center track transport belt 371 as in those systems shown in FIGS. 3, 3A-3D and 4. Instead, the double sided bin stacker section 710 of FIGS. 7 and 7A has a left side 712 and a right side 714 with an arrangement of adjacent, opposing and offset pocket 510 and 510A pairs. The offset and opposing pocket 510 and 510A pairs form a mail piece channel or path 715 where mail pieces will travel. As mail pieces travel in the mail piece path 715, they can be selectively diverted to a left or right bin 510 and 510A by an appropriate command to a transport assembly 530 mail piece diverter 558. FIG. 7 also illustrates that the tray management system 745 is preferably operatively positioned in an area below the first tier of a mail handling system using the double sided stacker sections 710. The tray management system can improve the handling efficiency of the mail handling system. The double sided stacker section 710 can be used in a mail processing system having a single tier double sided stacker section configuration 740. Those of skill in the art will readily recognize that the single tier double sided stacker configuration 740 can be adapted for vertical and or horizontal progressive modularity, i.e., vertical or horizontal expansion.

FIGS. 7 and 7A show the mail piece channel or path 715 formed by the opposing and cooperating main transport belts 541 on each of the opposing, adjacent and staggered bin transport assemblies 530. The cooperation of the opposing main transport belts 541 form the mail piece channel or path 715 and allow mail pieces to travel in the mail piece channel or path along the length of the double side sided stacker section 710 until the mail pieces are diverted into a selected bin or pocket 510 or 510A by appropriate actuation of the downstream mail piece tray diverter 558 by the energized solenoid 554 in the solenoid diverter assembly 555. The mail pieces can be selectively diverted to either a bin 510 on the left side 712 of the stacker section 710 or to a bin 510A on the right side 714 of the double sided stacker section 710.

For vertical progressive modularity, the single tier double sided stacker 740 with a tray management system 745 can be vertically expanded to a multi-tiered double sided stacker configuration with a tray management system 745 by adding adjustable mounting posts 755 and attachable tier base supports 757 (more clearly shown in FIGS. 8A and 8B) or other support means to support additional stacker sections 710 with the novel pockets 510 and 510A. For example, FIG. 7 illustrates examples of mail processing systems having a two-tiered and a three-tiered double sided stacker configurations 750, 760 and 770 with a tray management system 745. Horizontal progressive modularity can be accomplished by adding additional double sided stacker sections 710 in an outward direction from existing double stacker sections 710 (as shown in FIG. 9).

FIG. 7 also illustrates that the mail processing system with a two-tier double sided stacker configuration 770 with the tray management system 745 can further comprise a left and right side upper rack configuration 772 and 774. The additional left and right upper rack configuration 772 and 774 is a useful component for improving the handling and sorting of mail pieces. Also, the left and right side upper rack configuration 772 and 774 can be used on both the left and right sides as shown or can be on either the left or right side as desired or needed in a mail handling facility. Also, those of skill in the art will recognize that the left and right side upper rack configuration 772 and 774 could also be used in mail processing systems with a single or other multi-tiered double sided stacker configuration 740 and 760 with the tray management system 745.

FIG. 7 also illustrates that that the bins or pockets 510 and 510A can be either high capacity 510 and 510A or low capacity bins or pockets 710 and 710A. The low and high capacity pockets are preferably identical in configuration with the low capacity bin 710 and 710A having a short tray 713 and the high capacity bin 510 and 510A having a long tray 713. The upper tiers preferably use the low capacity bins 710 and 710A and the low or first tiers preferably use a high capacity bin or pocket 510 and 510A. However, the low and high capacity bins or pockets 710, 710A, 510 and 510A can be used on any desired tier level and can also be mixed on the same tier if desired.

Figure 8A:
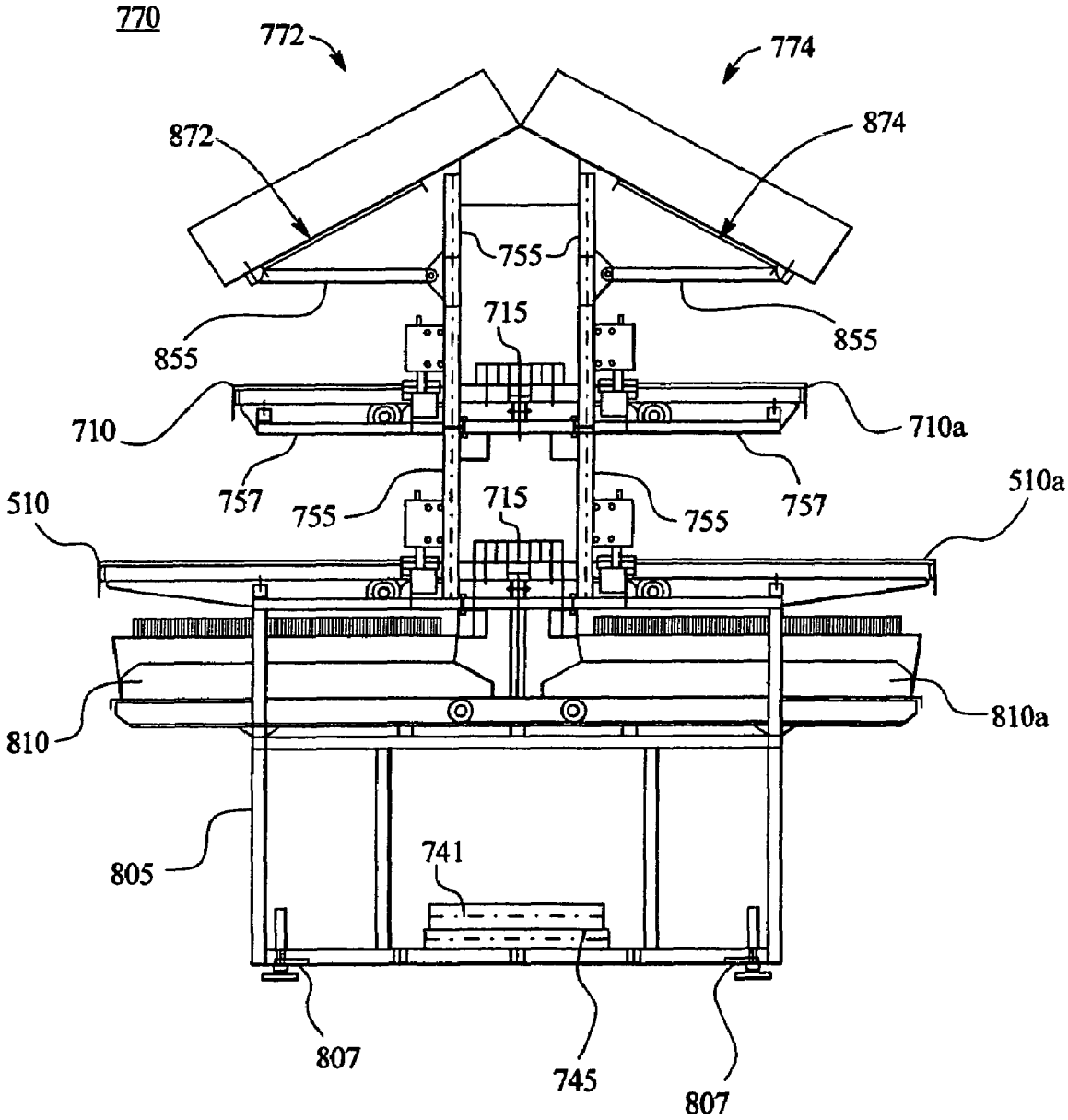
FIGS. 8A and 8B illustrate a mail processing system that uses a tray management system with a two-tier double sided stacker configuration and upper rack configuration shown in FIG. 7.
Figure 8B:
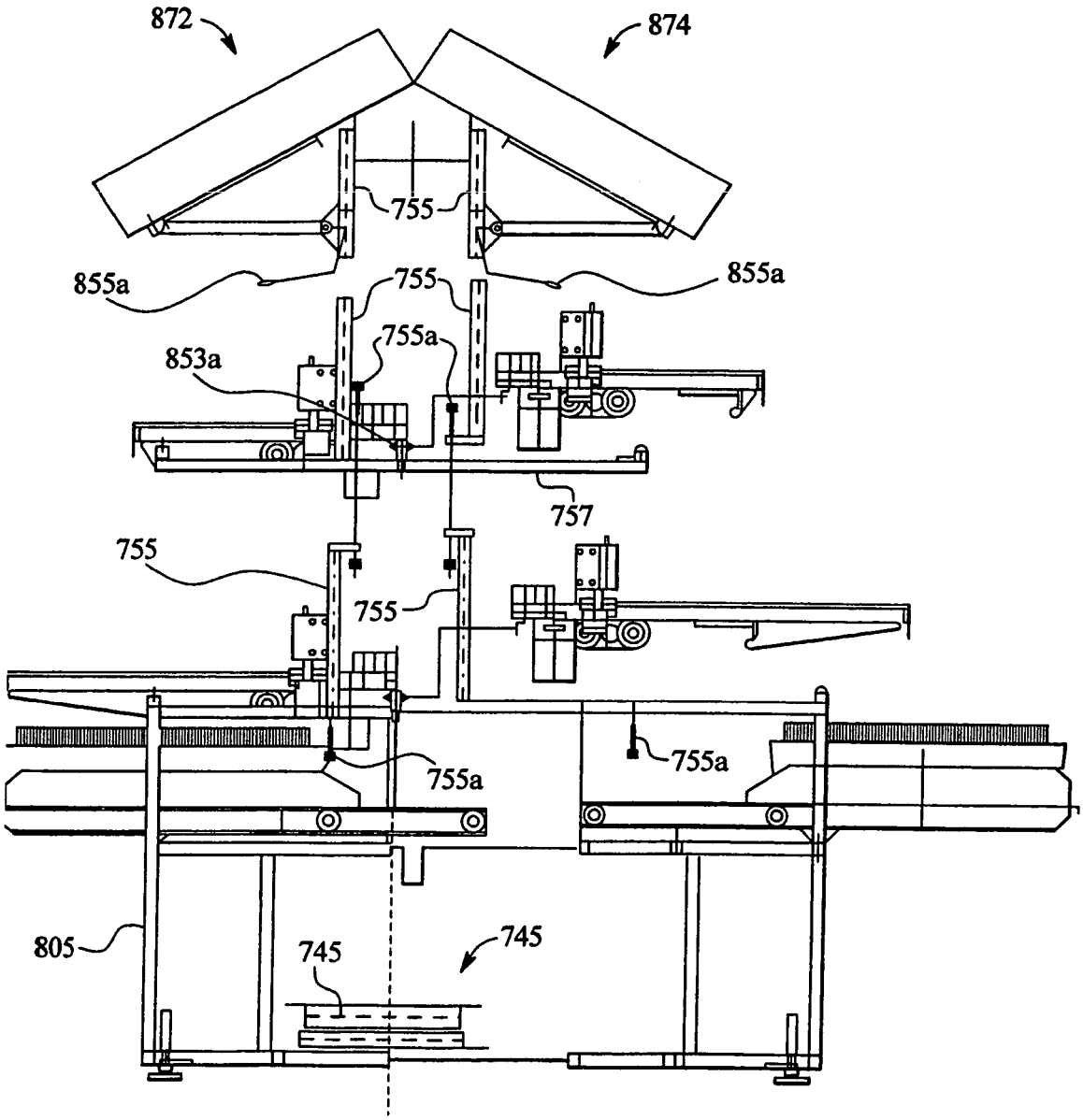
Figure 9:
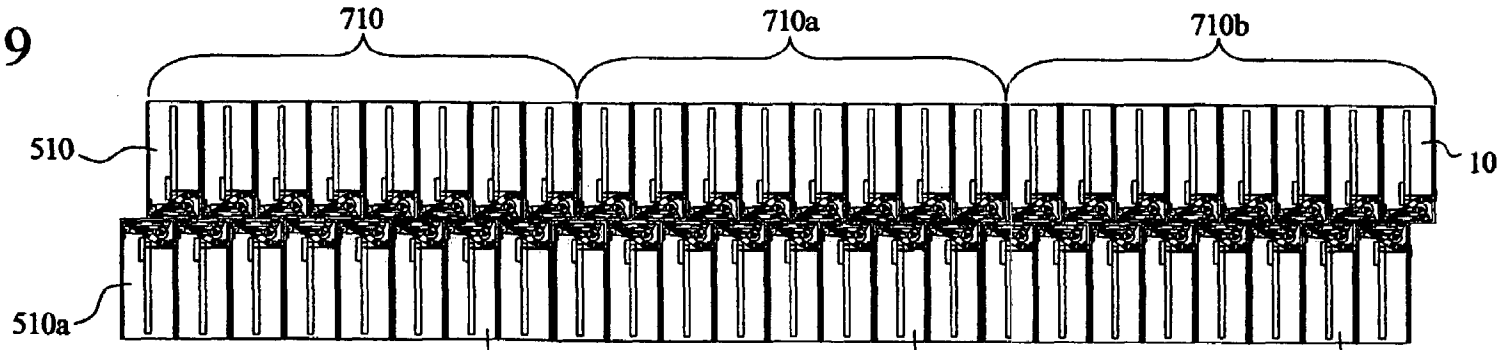
FIG. 9 shows an example of prior art horizontal expansion in a mail handling system using standard double sided stacker sections with staggered bin pairs.

FIGS. 8A and 8B illustrate, in greater detail, the mail processing system with the two-tier double sided stacker configuration 770 with the tray management system 745 and the left and right side upper rack configuration 772 and 774 of FIG. 7. The additional left and right upper rack configuration 772 and 774 can comprise a support base 855, which is attached to a set of adjustable mounting posts 755, and a left and right attachable upper rack 872 and 874 which are positioned on the support base 855 in a generally inclined configuration. The left and right attachable upper racks 872 and 874 can be used for selected mail pieces. The examples of FIGS. 8A and 8B further show a mail handling system with operatively positioned high capacity bins or pockets 510 and 510A on the first tier and low capacity 710 and 710A bins on the second tier. Again, the low and high capacity bins or pockets 710, 710A, 510 and 510A can be used on any desired tier level and can also be mixed on the same tier if desired.

The high capacity bins or pockets 510 and 510A on the first tier and low capacity 710 and 710A bins on the second tier are shown positioned and secured on their respective tier base supports 757 and supported by the adjustable mounting posts 755. Further, the bins or pockets 510, 510A, 710 and 710A are operatively positioned adjacent to each other at their rear ends to form an appropriate mail piece channel 715. The mail handling system shown in FIG. 8A also shows a left and right slide tray 810 and 810A that are positioned below respective high capacity bins 510 and 510A. The slide trays 810 and 810A can be used to store mail pieces previously diverted to the high or low capacity bins 510, 510A, 710 and 710A. FIG. 8A further shows that the mail handling system can have a base support section 805 with height adjusting mechanism or means that allow the system to be properly leveled or adjusted in height for ergonomic or other reasons.

FIG. 8B is a partial exploded view of the system shown in FIG. 8A, which more clearly illustrates an assembly of the mail handling system. FIG. 8B illustrates that fasteners 755A can be used to secure the adjustable mounting posts 755 to the system base support 805, and to secure sets of mounting posts 755 to each other and the tier base supports 757. Further, locking pins 855A are preferably used to secure the mounting post 755 that support the attachable upper racks 872 and 874. Those of skill in the art will readily recognize that other fastening or securing means may be used to secure the mounting posts 755, the tier base supports 757 and attachable upper racks 872 and 874.

FIG. 9 illustrates an example of horizontal progressive modularity or horizontal expansion that could be done for the mail handling system of FIG. 7. In this case, the mail handling capacity of the system has been horizontally expanded by the addition of two standard double sided stacker sections 710A and 710B. As one of ordinary skill in the art can appreciate, any number of additional stacker sections can be added to meet capacity requirements.

Figure 10:
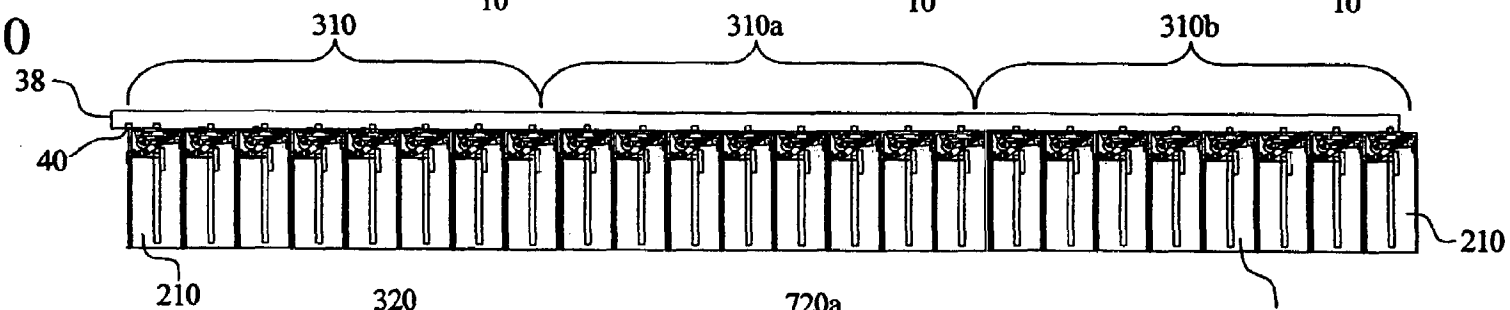
FIG. 10 shows an example of prior art horizontal expansion in a mail handling system using single sided stacker sections.

FIG. 10 illustrates a horizontal expansion that could be done on single sided single tier mail handling system 330 having only a front side 310 without a turnaround section as shown in FIG. 3. In this case, the mail handling capacity of the single sided system has been horizontally expanded by the addition of two standard front side single sided stacker sections 310A and 310B. In the system of FIG. 10, the series of transport mechanisms on each bin 210 cooperate with a system transport belt and roller mechanism 38 to form a mail piece guide charge 210 where the mail pieces will travel until they are diverted into an appropriate bin or pocket 210.

Figure 12:
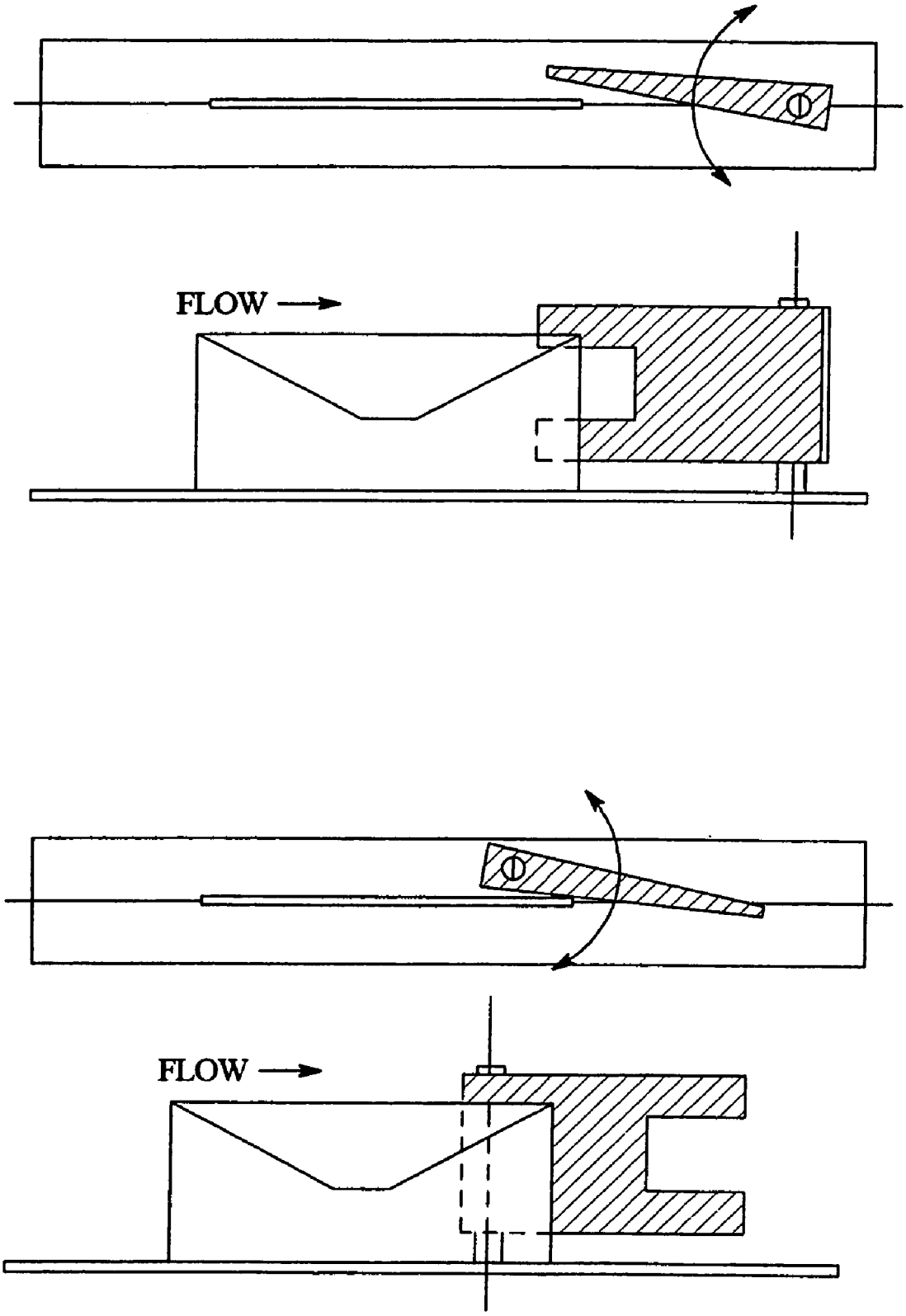
FIG. 12 illustrates upstream and down stream diverter configurations for use in mail handling systems.

FIG. 11 illustrates a horizontal expansion that could be done on the single sided stacker section system with turnaround section 320 and 340 of FIG. 3. In this case, the mail handling capacity of the single sided system has been horizontally expanded by the addition of one standard front side 324 and rear side 322 single sided stacker section 720A with a turnaround section 326. Such an expansion, having three tiers could similarly be carried out for the multi-tier single sided systems 350 and 360 of FIG. 3. FIG. 12 illustrates upstream or down stream diverters that could be used in mail handling systems depending on a user's preference and system applications. The examples discussed preferably use a downstream diverter configuration. However, those of skill in the art will recognize that the examples disclosed can use either diverter configuration.

Figure 14A:
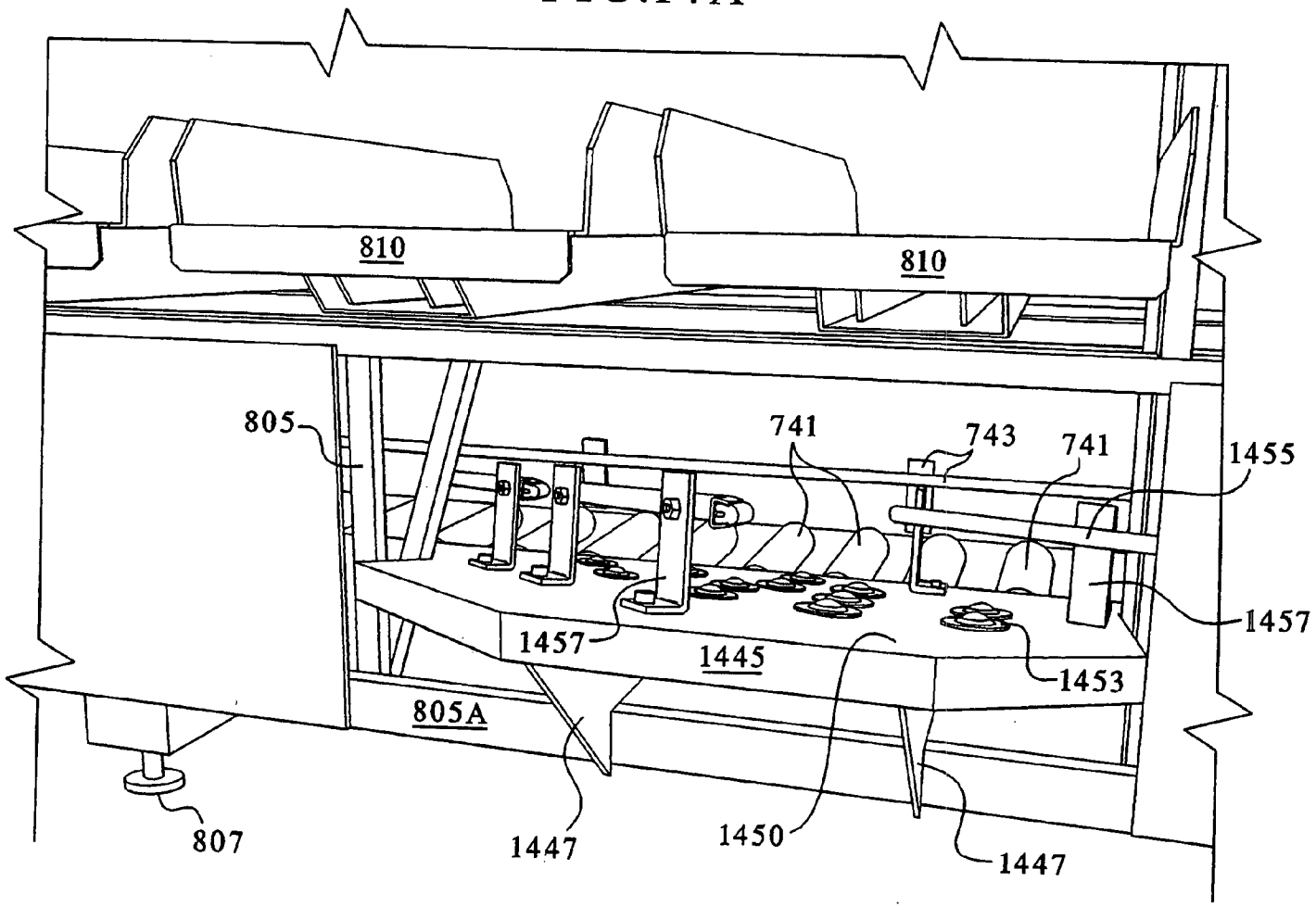
FIGS. 14A-14D illustrate an example of a take-away ramp usable in a mail handling system using a tray management system.
Figure 14B:
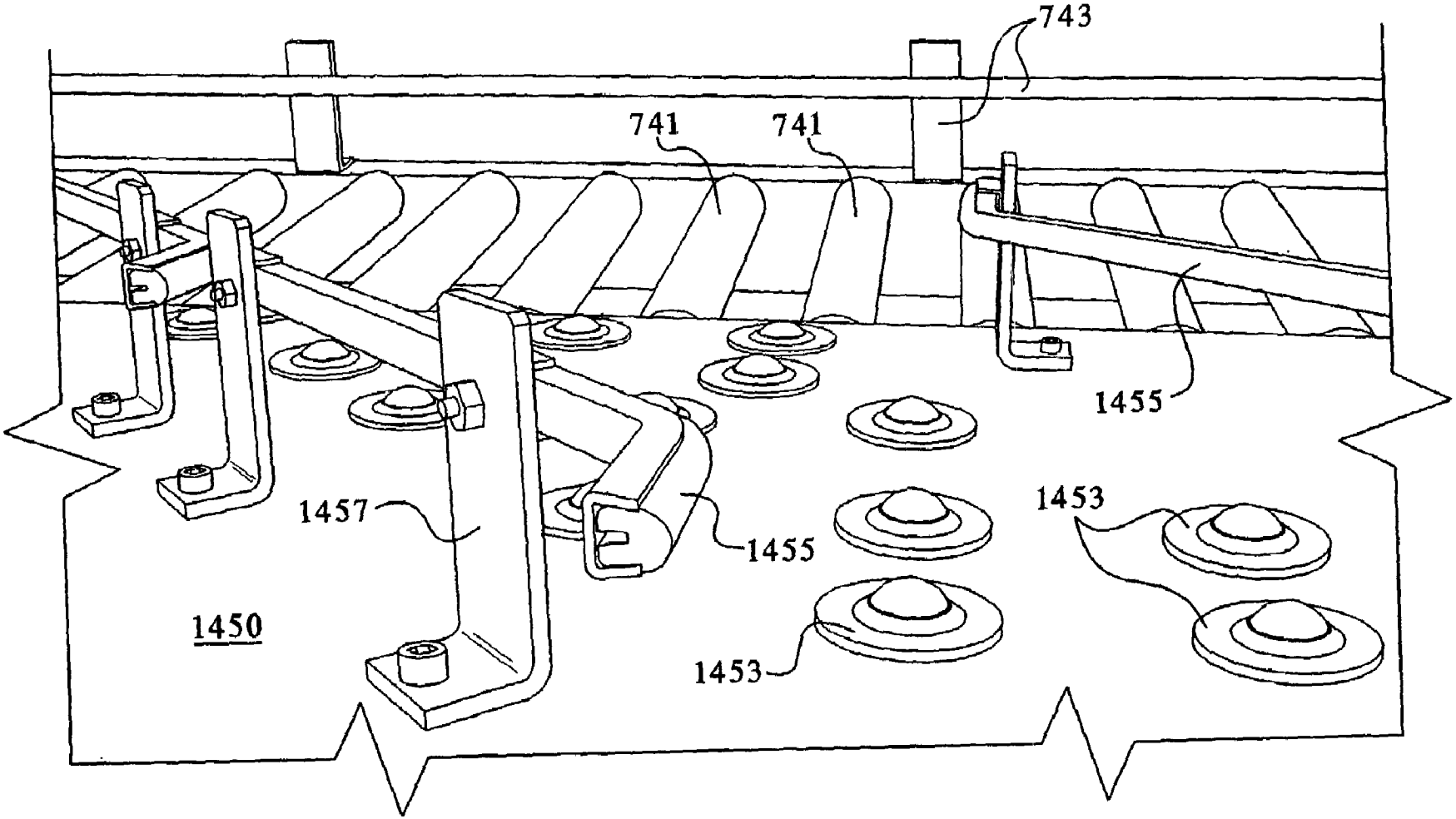

FIGS. 14A and 14B show an example of a take-away ramp 1445 that can be used with mail handling systems using a tray management system 745. The mail handling system can be any one of those already disclosed in the discussion referring to of FIGS. 2-13D, whether in single or multi-tiered configurations and whether using single or double sided stacker section configurations shown in FIGS. 3, 4, 7 and 8A-8B. The take-away ramp 1445 can be used as a means to transport or direct loaded mail piece containers to the tray management system 745 shown in FIGS. 14C and 14D. The take-away ramp 1445 is preferably positioned in an area beneath a slide tray 810 and a horizontal based support 805A of the mail handling system. Further, the take away ramp 1445 is preferably situated in an inclined position and in a working relationship to the tray management system 745 by a pair of ramp positioners 1447 coupled to a horizontal base support 805A.

Figure 14C:
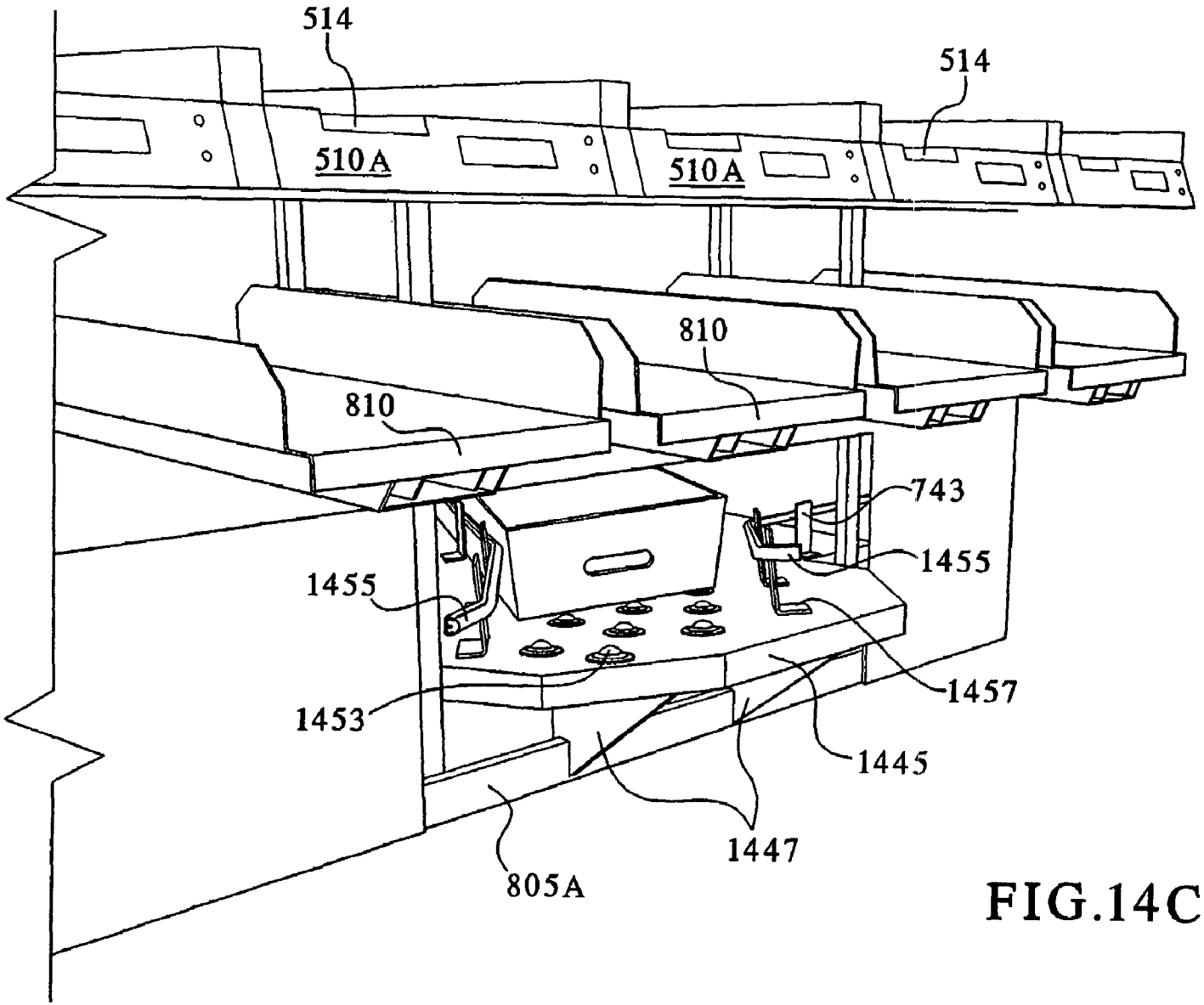
Figure 14D:
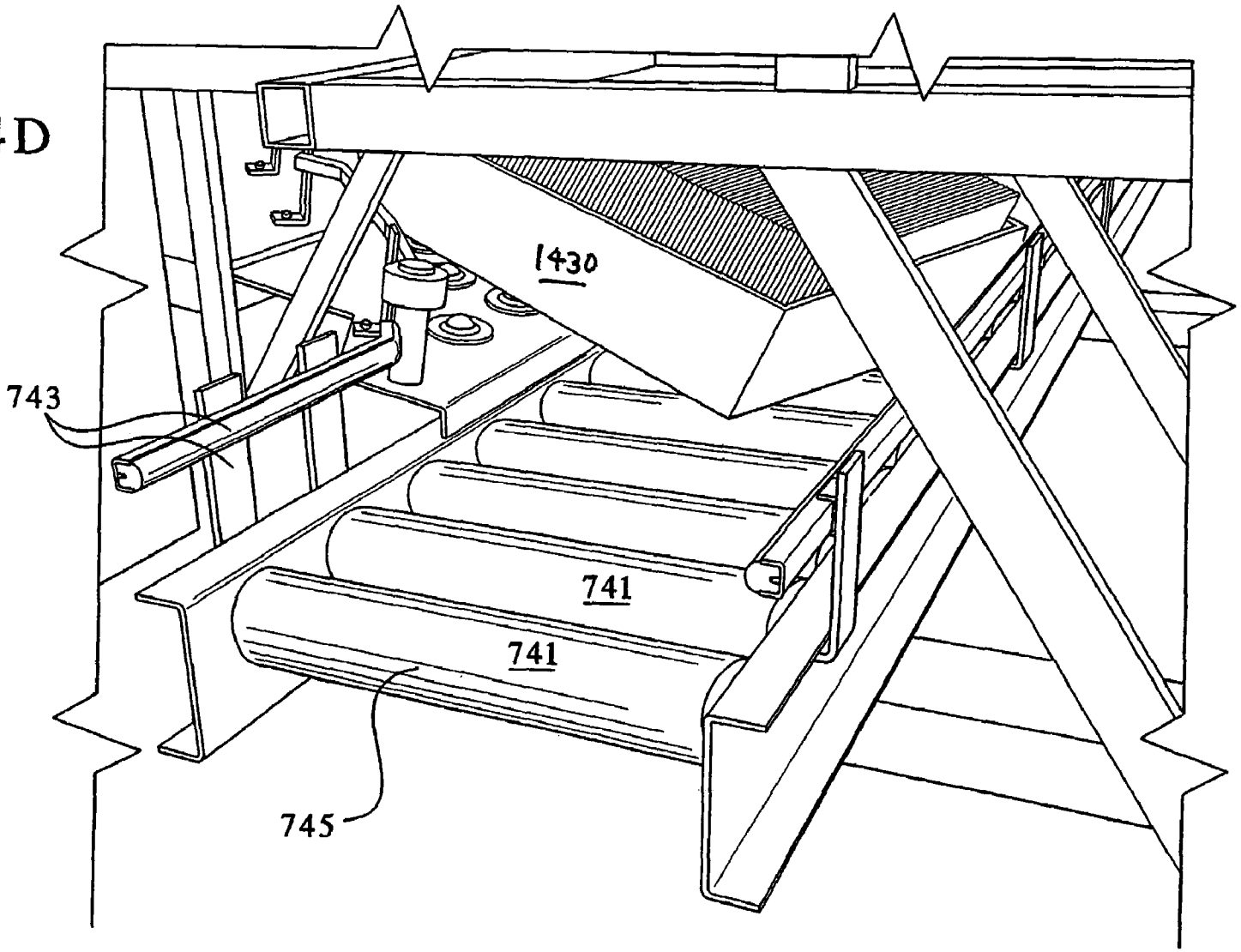

In the example shown in FIGS. 14A and 14B, the take-away ramp 1445 preferably comprises a plurality of spherical ramp rollers 1453 or bearings disposed on a top ramp surface 1450. The take-away ramp further comprises a pair of guide rails 1455 supported by rail supports 1457 attached to the top ramp surface 1450. When a loaded mail piece container is placed on the take-away ramp 1445, the ramp rollers 1453 facilitate the movement, toward the tray management system 745, of the loaded mail piece container that is provided by the inclined take-away ramp 1445. And, the guide rails 1455 direct or provide a travel pathway for the loaded mail piece container, as shown in FIGS. 14C and 14D, towards the tray management system 745. In the example shown, the various parts or components that make up the take-away ramp 1445 are steel or other metallic material, however, other non-metallic materials can be used such as plastic, wood or other known materials.

FIGS. 14B and 14D also show that in one example, the tray management system 745 comprises a plurality of transport rollers 741 attached to one or more roller supports 742 and adapted to transport a mail piece container 1430 containing mail pieces to be transported via the tray management system 745. The transport rollers 741 can be interconnected or coupled in working pairs or in another known manner by a plurality of roller actuation belts 744 to thereby rotate the transport rollers 741 in a desired transport direction. The tray management system 745 also comprises one or more transport guide rails with associated rail supports 743 cooperatively positioned to guide the mail piece container 1430 being transported on the transport rollers 741. The tray management system 745 can receive a mail piece container 1430 via a take-away ramp 1445 operatively positioned in an inclined position to deliver the mail piece container 1430 to the transport rollers 741.

Figure 15A:
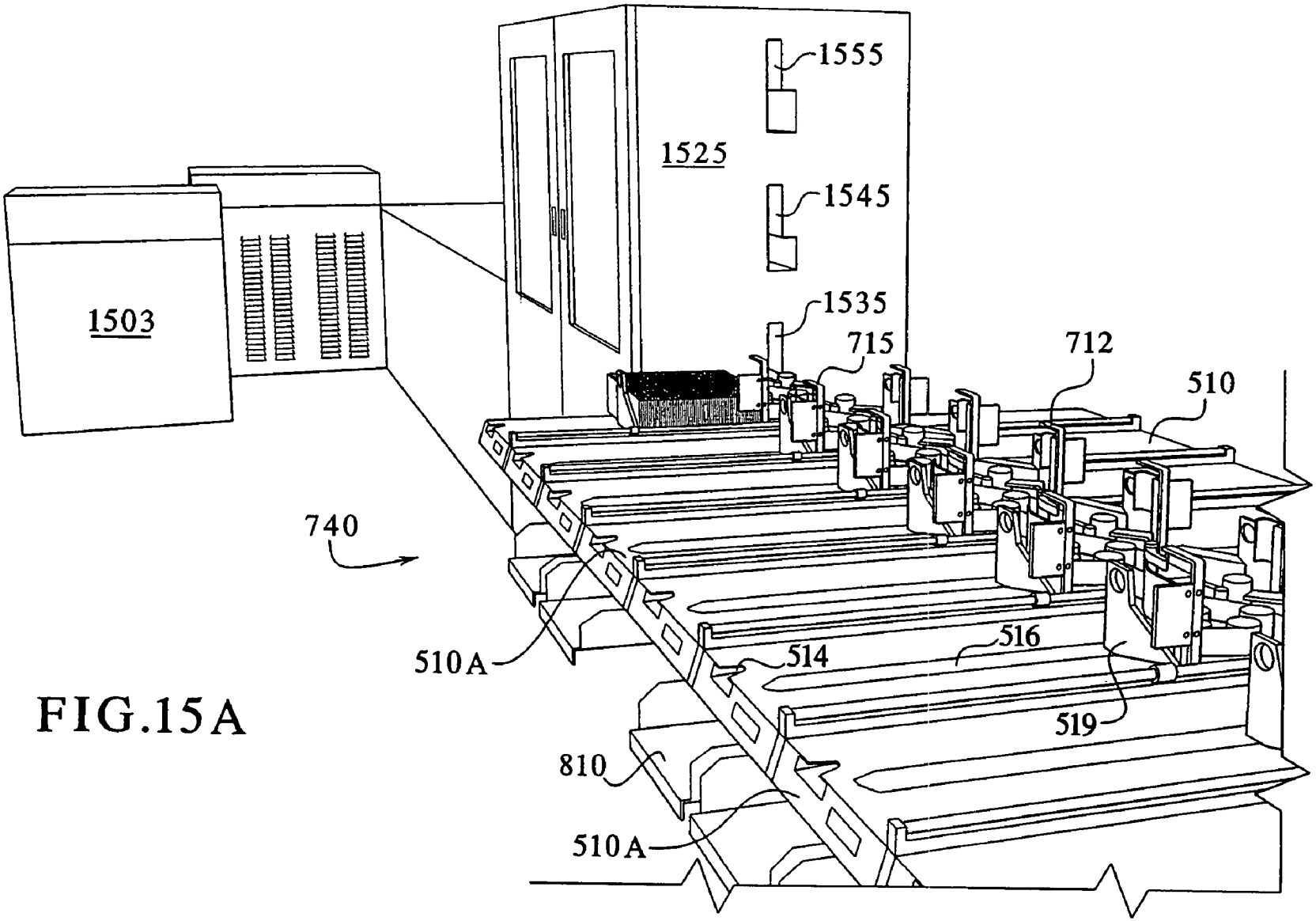
FIGS. 15A and 15B illustrate an example of tier diverter system usable in a mail handling system.
Figure 15B:
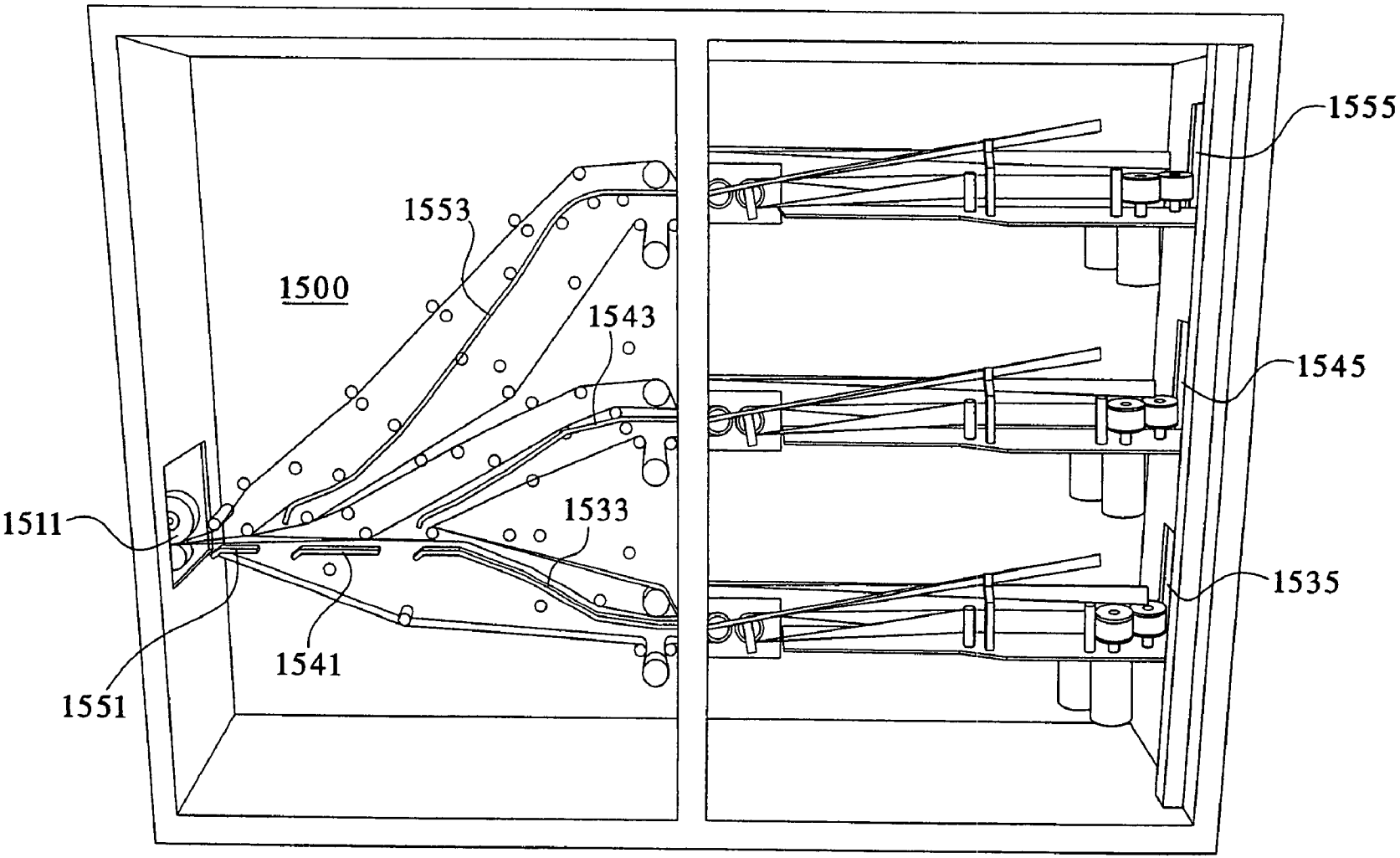

FIGS. 15A and 15B illustrate a tier diverter system 1500 preferably housed in a transition section 1525 that can be used with mail handling systems that use single or multi-tier configurations such as the single and multi-tier configuration 740, 750, 760 and 770 shown in FIGS. 7, 8A and 8B. In the example shown in FIG. 15A, the mail handling system uses single double sided bin stacker section 710 tier with a left 712; and right side 714 arrangement of adjacent, opposing and offset bin or pocket 510 and 510A pairs. One double sided bin stacker section 710 tier is shown in the mail handling system, however, the mail piece transition section 1525 shows that the mail handling system can be expanded vertically by the addition of one or two double sided bin stacker section 710 tiers, such as the multi-tiered configurations 750, 760 and 770 illustrated in FIGS. 7, 8A and 8B. Those of skill in the art will readily recognize that the mail handling system show in FIG. 15A can be adapted for vertical and or horizontal progressive modularity, i.e., vertical or horizontal expansion.

The tier diverter system 1500 preferably comprises one or more mail flow exit-ways 1535, 1545 and 1555 in the transition section 1525 that correspond to the number of tiers in the mail handling system. The mail flow exit-ways 1535, 1545 and 1555 are located or positioned on the transition section 1525 in such a manner that mail pieces coming out of the mail flow exit-ways 1535, 1545 and 1555 will be aligned with corresponding mail piece channels or paths 715 in the appropriate tier or level of double sided bin stacker sections 710. In the case shown in FIG. 15A, all the mail flow would be directed to a bottom or default mail flow exit-way 1535 since there is only one tier or default tier in the mail handling system. In this manner, mail pieces diverted in the tier diverter system 1500 and coming out of the exit-ways 1535, 1545 and 1555 will proceed into the correct mail piece channel or path 715 for subsequent selective diversion into a pocket or bin 510 and 510A in the double sided bin stacker section 710.

FIGS. 15A and 15B show that, in one example, the tier diverter system 1500 can comprise a plurality of mail flow pathways 1533, 1543 and 1553 and mail flow pathway diverters 1551 and 1541 which are preferably located in the transition section 1525. The mail flow pathways 1533, 1543, and 1553 can comprise a system of cooperating belts, idle rollers, motorized rollers and mail guides that cooperate to transport mail pieces from the mail flow entry-way 1511 to a selected mail flow exit-way 1535, 1545 and 1555. Further, the mail flow pathways 1533, 1543, and 1553 can orient the transported mail pieces such that the mail pieces exiting the mail flow exit-ways 1535, 1545 and 1555 are appropriately aligned and oriented with the adjacent mail piece channel or path 715 of the double sided bin stacker section 710 tier that the transported mail piece will travel into. For example, the mail flow pathways 1533, 1543, and 1553 may transport a mail piece that arrives at the mail flow entry-way 1511 in a flat or horizontal position and deliver the mail piece to the mail flow exit-ways 1535, 1545 and 1555 in a vertical position or orientation.

The tier diverter system 1500 also comprises a plurality of mail flow pathway diverters 1551 and 1541 that are selectively actuated to divert incoming mail pieces to a corresponding or associated mail flow pathway. In the example shown in FIG. 15B, a third tier diverter 1551 is positioned to selectively divert mail pieces from a first or bottom mail flow pathway 1533 to a corresponding top or third mail flow path way 1553 for transportation of the mail pieces to the top or third mail path exit-way 1555 when a top or third tier double sided bin stacker section is used in the mail handling system. Also, a middle or second tier diverter 1541 is positioned to selectively divert incoming mail pieces from a first or bottom mail flow pathway 1533 to the middle or second mail flow path way 1553 for transportation of mail pieces to middle or second mail path exit-way 1545 when a middle or second tier double sided bin stacker section is used in the mail handling system.

In the example shown in FIG. 15B, the bottom or first mail flow pathway 1533 is a default mail flow pathway for incoming mail pieces that have been routed to the transition section 1525 by the front end 1503 of the mail handling system and, in this example, does not have an associated tier diverter. Those of skill in the art will readily recognize that the tier diverter system 1500 could readily be modified to include a tier diverter for the bottom or first mail flow path way 1533. In the depicted example, incoming mail pieces entering the mail flow entry-way 1511 would continue to travel in the first, bottom or default mail flow path way 1533 and be transported to the bottom or default mail flow exit-way 1535 which corresponds to the bottom or first tier double sided bin stacker section 710. The transported mail piece would then travel in the mail piece channel or path 715 for diversion into a selected pocket or bin 510 and 510A.

In this example, the mail piece entering the tier diverter system 1500 will travel by default through the bottom or first mail flow path way 1533. In order for mail pieces to be diverted to the top or third mail flow path way 1553 or middle or second mail flow path way 1553, the corresponding mail flow pathway diverters 1551 and 1541, respectively, must be selectively actuated for diversion of incoming mail pieces to the desired mail flow pathway 1543 or 1553. Those of skill in the art will readily recognize that the actual mail flow path ways 1533, 1543 and 1553 traveled by the mail pieces can also be selective chosen or programmed in the mail handling system by manipulation of the tier diverters 1551 and 1541. Also, the tier diverter system 1500 can have additional mail flow path ways with associated tier diverters and mail path exit-ways for the transportation of mail pieces when additional tiers of bin stacker sections are used in the mail handling system. Further, those of skill in the art will recognize that the tier diverter system 1500 can be used with single sided and double side bin stacker sections such as those shown in FIGS. 2-11.

Certain examples have been described and illustrated with respect to certain preferred examples by way of example only. Those skilled in that art will recognize that the preferred examples may be altered or amended without departing from the inventive spirit and scope of the subject matter. Therefore, the subject matter is not limited to the specific details, representative devices, and illustrated examples in this description. The novel subject matter is limited only by the following claims and equivalents.

We claims:

1. A removable modular sort bin for use in a stacker section of a mail sorting system, the modular sort bin comprising:

a tray for receiving mail pieces selectively diverted from a transport path of the stacker section;

an integral transport assembly at a rear end of the tray comprising a motor and a transport belt driven by the motor; and a coupling, for operatively positioning and detachably securing the removable modular sort bin, including the tray, motor and transport belt, along the transport path of the stacker section, in a position where the driven transport belt cooperates with opposing elements of the stacker section to move mail pieces along the transport path and the tray receives the selectively diverted mail pieces.

2. The bin of claim 1, wherein the coupling comprises:

a latch member adapted to secure the tray to a base support of the stacker section; and a bin locating slot adapted to properly position the bin in the stacker section of the mail sorting system.

3. The bin of claim 1, wherein the transport assembly comprises:

a main transport motor;

a main transport belt, driven by the main transport motor, for facilitating mail piece transport along a portion of the transport path;

a tray entry belt able to move diverted mail pieces into the tray; and a counting and tracking sensor for sensing mail pieces.

4. The bin of claim 1, further comprising a diverter mounted on the sort bin module, for selectively diverting mail pieces from the transport path to an opposing sort bin module.

5. A removable sort bin module for use in a stacker section of a mail sorting system, the sort bin module comprising:

a tray for receiving mail pieces selectively diverted from a transport path of the stacker section;

an integral transport assembly at a rear end of the tray comprising a motor and a transport belt driven by the motor for cooperation with an element of an opposing sort bin module mounted on a side of the transport path opposite the sort bin module, to move mail pieces along the transport path between the sort bin modules;

a diverter mounted on the sort bin module, for selectively diverting mail pieces from the transport path to the opposing sort bin module; and a coupling, for operatively positioning and detachably securing the sort bin module, including the tray, motor and transport belt, along the transport path across from the opposing sort bin module.

6. The sort bin module of claim 5, wherein the coupling comprises:

a latch member adapted to secure the tray to a base support of the stacker section; and a bin locating slot adapted to properly position the bin in the stacker section.

7. The sort bin module of claim 5, wherein, when activated to divert a mail piece, the diverter extends downstream and somewhat across the transport path toward the opposing sort bin module.

* * * * *